US009708904B2

(12) United States Patent
McGarian et al.

(10) Patent No.: US 9,708,904 B2
(45) Date of Patent: Jul. 18, 2017

(54) DETERMINING WHETHER A WELLBORE SEALING OPERATION HAS BEEN PERFORMED CORRECTLY

(75) Inventors: Bruce McGarian, Stonehaven (GB); William Brown-Kerr, Stonehaven (GB)

(73) Assignee: Halliburton Manufacturing and Services Limited, Dyce, Aberdeen (GB)

( * ) Notice: Subject to any disclaimer, the term of this patent is extended or adjusted under 35 U.S.C. 154(b) by 262 days.

(21) Appl. No.: 14/127,066

(22) PCT Filed: May 16, 2012

(86) PCT No.: PCT/GB2012/051088
§ 371 (c)(1),
(2), (4) Date: Jul. 30, 2014

(87) PCT Pub. No.: WO2012/156730
PCT Pub. Date: Nov. 22, 2012

(65) Prior Publication Data

US 2014/0338896 A1 Nov. 20, 2014

(30) Foreign Application Priority Data

May 16, 2011 (GB) ..... 1108098.3

(51) Int. Cl.
*E21B 47/06* (2012.01)
*E21B 47/10* (2012.01)
*E21B 47/00* (2012.01)

(52) U.S. Cl.
CPC ..... *E21B 47/1025* (2013.01); *E21B 47/0005* (2013.01); *E21B 47/06* (2013.01); *E21B 47/10* (2013.01)

(58) Field of Classification Search
CPC ..... E21B 2021/006; E21B 2033/105; E21B 47/06; E21B 47/124; E21B 49/008
USPC ..... 166/250.08
See application file for complete search history.

(56) References Cited

U.S. PATENT DOCUMENTS 6,125,935 A * 10/2000 Shahin, Jr. ..... E21B 33/14 166/250.14
6,408,943 B1 6/2002 Schultz et al.
(Continued)

FOREIGN PATENT DOCUMENTS

EP 2177712 A1 4/2010
WO 2011004180 A2 1/2011

OTHER PUBLICATIONS

Official Action for Colombian Patent Application No. 13-270.444 dated Dec. 10, 2014.
(Continued)

*Primary Examiner* — Angela M DiTrani
*Assistant Examiner* — Ashish Varma
(74) *Attorney, Agent, or Firm* — McDermott Will & Emery LLP

(57) ABSTRACT

The invention relates to methods of determining whether a wellbore sealing operation has been performed correctly, and to wellbore-lining tubing which facilitates the determination of whether a wellbore sealing operation has been performed correctly. The invention has a utility in determining whether cement has been correctly supplied into an annular region defined between an internal wall of a wellbore and an external surface of a wellbore-lining tubing located in the wellbore, or whether a packer has been properly set to seal such an annular region. One disclosed method comprises the steps of: locating a wellbore-lining tubing (140) in a wellbore (100), said tubing having at least one pressure sensor (80); performing a wellbore sealing operation in an annular region (178) defined between an external surface of said tubing and an internal surface (130) of a wall of the wellbore, or between an external surface of
(Continued)

said tubing and an internal surface of another wellbore-lining tubing (118) in which said tubing is located, to seal said tubing in the wellbore; monitoring the pressure of fluid in the annular region using the at least one pressure sensor; and recovering data concerning the pressure of the fluid monitored by the sensor to surface, the pressure data indicating whether the wellbore sealing operation has been performed correctly.

13 Claims, 12 Drawing Sheets

(56) References Cited

U.S. PATENT DOCUMENTS

| | | | | |
|---|---|---|---|---|
| 6,429,784 | B1 | 8/2002 | Beique et al. | |
| 6,693,554 | B2 | 2/2004 | Beique et al. | |
| 2002/0157828 | A1 | 10/2002 | King et al. | |
| 2004/0047534 | A1* | 3/2004 | Shah | E21B 23/08 385/12 |
| 2005/0014516 | A1 | 1/2005 | Rached et al. | |
| 2008/0007421 | A1 | 1/2008 | Liu et al. | |
| 2008/0060846 | A1* | 3/2008 | Belcher | E21B 17/042 175/25 |
| 2008/0236814 | A1 | 10/2008 | Roddy | |
| 2008/0272931 | A1 | 11/2008 | Auzerais et al. | |
| 2010/0051275 | A1 | 3/2010 | Lewis et al. | |
| 2010/0139386 | A1 | 6/2010 | Taylor | |

OTHER PUBLICATIONS

Cooke et al., "Field Measurements of Annular Pressure and Temperature During Primary Cementing," Journal of Petroleum Technology, AIME, Dallas, TX, 1983, pp. 1429-1438, XP002050239.

* cited by examiner

DETERMINING WHETHER A WELLBORE SEALING OPERATION HAS BEEN PERFORMED CORRECTLY

The present invention relates to methods of determining whether a wellbore sealing operation has been performed correctly. The present invention also relates to wellbore-lining tubing which facilitates the determination of whether a wellbore sealing operation has been performed correctly. In particular, but not exclusively, the present invention relates to methods for determining whether cement has been correctly supplied into an annular region defined between an internal wall of a wellbore and an external surface of a wellbore-lining tubing located in the wellbore; or whether a packer has been properly set to seal an annular region between an internal wall of a wellbore and an external surface of a wellbore-lining tubing located in the wellbore, or between two wellbore-lining tubings, one being of larger diameter than the other.

In the oil and gas exploration and production industry, wellbore fluids comprising oil and/or gas are recovered to surface through a wellbore which is drilled from surface. The wellbore is lined with metal wellbore-lining tubing, which is known in the industry as 'casing'. The casing serves numerous purposes, including: supporting the drilled rock formations; preventing undesired ingress/egress of fluid; and providing a pathway through which further tubing and downhole tools can pass.

The casing comprises sections of tubing with threaded ends, which are coupled together using casing collars, or upset ends incorporating a mating box for connection with a corresponding pin end on an adjacent casing section. Some casings have flush joints. Typically, the wellbore is drilled to a first depth and a casing of a first diameter installed in the drilled wellbore. The casing extends along the length of the drilled wellbore to surface, where it terminates in a wellhead assembly. The casing is sealed in place by pumping 'cement' down the casing, which flows out of the bottom of the casing and along the annulus defined between the external surface of the casing and the internal surface of the drilled wellbore.

Following appropriate testing, the wellbore is normally extended to a second depth, by drilling a smaller diameter extension of the wellbore through a cement plug at the bottom of the first, larger diameter wellbore section. A smaller diameter second casing is then installed in the extended portion of the wellbore, extending up through the first casing to the wellhead. The second casing is then also cemented in place. This process is repeated as necessary, until the wellbore has been extended to a desired depth, from which access to a rock formation containing hydrocarbons (oil and/or gas) can be achieved. Frequently a wellbore-lining tubing is located in the wellbore which does not extend to the wellhead, but is tied into and suspended (or 'hung') from the preceding casing section. This tubing is typically referred to in the industry as a 'liner'. The liner is similarly cemented in place within the drilled wellbore. Expandable wellbore-lining tubing is also known in the industry, and is run-into a wellbore and subsequently expanded to a larger diameter. Expandable tubing offers a number of advantages. For example, an expandable liner can be located in a wellbore without a further significant restriction of the wellbore diameter, by expanding the liner downhole.

The wellbore casing carries a casing 'shoe' at its lowermost end, which is a short, heavy annular joint with a rounded external surface that helps to prevent the casing from becoming hung-up on any ledges or obstructions in the wellbore during running-in. A 'float collar' is located above the shoe, and includes a one way valve (typically a flapper or poppet type valve). The valve allows fluid to flow from the casing into the wellbore, but prevents returns. It also prevents wellbore fluid flowing into the casing during running-in. The portion of casing between the shoe and the float collar defines a 'shoe track', and may comprise one or more lengths of interconnected casing sections. A main purpose of the shoe track is to ensure that the shoe is surrounded by cement.

Typically, the cement supplied down the casing is positioned between lower and upper 'wipers'. The wipers provide a sliding seal with an internal surface of the casing, and a physical barrier between the cement and other fluids in the wellbore. The wiper which is lowermost in the casing lands and latches to the float collar. Pressure is then applied to the fluid in the casing above the upper wiper, causing a burst disc or the like in the lower wiper to rupture. The cement located between the two wipers is then urged through a central bore in the lower wiper, through the shoe track, out of the casing shoe and into the wellbore. The pressure applied to the cement is sufficient to cause the cement to travel up the annulus, to seal the casing in the wellbore when the cement sets. When the required volume of cement has been supplied into the annulus, the upper wiper seats on and latches into the lower wiper. The wipers and the float collar together form a plug which prevents cement from flowing back into the casing and 'U-tubing'—a situation where the cement reaches an equilibrium position in which it extends the same distance along the inside of the casing as outside. Where a liner is employed, the method is similar, but must take to account of the fact that the liner is of a smaller internal diameter than the casing string that it is suspended from. The technique is well known in the field of the invention, and employs a smaller diameter dart or darts located in a running string coupled to the liner, and a ported wiper or wipers located in the liner itself. The cementing process may also be carried out using one wiper assembly only, which follows the cement plug. A clean fluid flush or 'pill' of fluid would precede the cement (and a similar such flush or pill may also follow the wiper).

Significant problems can occur with the cementing procedure. In particular, when the cement is pumped, cement may be lost into a rock formation, washout, 'vugs' (cavities or voids in the rock), cracks and so on, rather than into the annulus. This results in an insufficient seal between the casing and the wellbore wall. If it is known that the drilled formation is likely to cause such problems, the cement may have additional materials such as fibres added to it, to bulk it up and block the potential fluid loss paths.

Whether or not such fibres are utilised, in conventional cementing operations there is a delay whilst the cement sets. A cement bond log is then typically carried out, in which a logging tool is run into the wellbore to interrogate the wellbore and determine whether or not the cement has successfully travelled up along the annulus to the required position, and/or whether the cement remains 'green' and has not set properly. Drilling operations can then continue, in which the liner wiper plugs, float collar and cement below the collar in the shoe track are milled or drilled out. The downtime associated with awaiting setting of the cement and the performance of a cement bond log increases the cost of the drilling and completion procedure.

There have been proposals to monitor the temperature of cement supplied into the annulus of a wellbore, for the purpose of determining whether the cement has set, so that the next step in the drilling procedure can be performed (U.S. Pat. No. 6,429,784 assigned to Dresser Industries, Inc.). This is based on the understanding that the temperature of the cement varies during setting. A temperature sensor is coupled to a casing shoe and transmits data concerning the temperature of the cement to surface. However, this does not provide information concerning the extent to which the cement has travelled along the annulus to seal the casing. It merely provides an indication that there is cement in the region of the sensor in the shoe, and that the cement in that region has set.

Additionally, where a liner is employed, a sealing device known as packer is provided at the top of the liner, at the interface with the casing. A packer of this type is usually referred to in the industry as a 'liner-top packer'. The packer seals the annular region defined between an external wall of the liner, an internal wall of the larger diameter casing that the liner is located in, and the upper surface of cement that has been supplied into the wellbore to seal the liner. The packer may be carried by the liner or deployed independently, and includes a sealing element which can be deformed radially outwardly into sealing abutment with the wall of the casing. This is achieved by axially compressing the sealing element, by setting a certain amount of 'weight' on the packer. Currently, there is no known method for verifying that the packer has been correctly set and so provides an adequate seal. This is a particular problem in deviated wellbores, where it is difficult to set down the necessary weight to set the packer. The only indication that a packer has not been set correctly is if an unexpected leak/pressure drop is detected at surface, such as when pressure testing the liner assembly to check for pressure integrity.

The present invention seeks to obviate or mitigate at least one of the foregoing disadvantages.

According to a first aspect of the present invention, there is provided a method of determining whether a wellbore sealing operation has been performed correctly, the method comprising the steps of:

- locating a wellbore-lining tubing in a wellbore, said tubing having at least one pressure sensor;
- performing a wellbore sealing operation in an annular region defined between an external surface of said tubing and an internal surface of a wall of the wellbore, or between an external surface of said tubing and an internal surface of another wellbore-lining tubing in which said tubing is located, to seal said tubing in the wellbore;
- monitoring the pressure of fluid in the annular region using the at least one pressure sensor; and
- recovering data concerning the pressure of the fluid monitored by the sensor to surface, the pressure data indicating whether the wellbore sealing operation has been performed correctly.

The method may be a method of determining whether a wellbore sealing operation in the form of a wellbore cementation operation has been performed correctly, in which the step of performing the downhole sealing operation may comprise supplying a cement slurry into the annular region to seal said tubing in the wellbore; and in which the step of recovering data concerning the pressure of the fluid may comprise recovering data concerning the pressure of the cement slurry to surface, the pressure data indicating the extent to which the cement slurry has travelled along the annular region towards the surface, so that a determination can be made as to whether the cementation operation has been performed correctly.

The method may be a method of determining whether a wellbore sealing operation in the form of the setting of a packer in the annular region has been correctly performed. The packer may be coupled to said wellbore-lining tubing and run-into the wellbore with the tubing, or may be deployed into the wellbore following location of said tubing downhole. Said wellbore-lining tubing may be a liner, and the tubing in which the liner is located may be a casing, the annular region defined between the liner and the casing. Said wellbore-lining tubing may be a casing or liner located in the open wellbore, the annular region defined between the casing or liner and the wall of the wellbore. The step of performing the downhole sealing operation may comprise setting the packer by exerting a force on a sealing element of the packer to urge it into sealing abutment with the casing or wellbore wall. The step of performing the downhole sealing operation may comprise providing a packer having a swellable sealing element, which swells and radially expands into sealing abutment with the casing or wellbore wall on exposure to fluid in the wellbore. Such swellable packers and known in the industry, and have sealing elements which swell on exposure to hydrocarbon-containing fluids (e.g. oil), water or other fluids. The step of recovering data concerning the pressure of the fluid may comprise recovering data concerning the pressure of a fluid in the annular region downhole of the packer sealing element. The method may comprise supplying a cement slurry into the annular region to perform a primary sealing of the tubing in the wellbore, and positioning the packer uphole of the cement so that a space is defined between an uphole surface or end of the cement and the sealing element of the packer. The method may comprise monitoring the pressure of fluid in said space. A change in the pressure of the fluid may be indicative of a leak past the packer sealing element, and so that the packer has not been correctly set. The method may comprise both monitoring the pressure of the cement slurry using a pressure sensor, and monitoring the pressure of the fluid in said space using another pressure sensor. Whilst reference is made here to wellbore-lining tubing in the form of casing and liner, it will be understood that the principles apply to other types of wellbore-lining tubing known in the industry.

According to a second aspect of the present invention, there is provided a method of determining whether a wellbore cementation operation has been performed correctly, the method comprising the steps of:

- locating a wellbore-lining tubing in a wellbore, the tubing having at least one pressure sensor;
- supplying a cement slurry into an annular region defined between an external surface of the tubing and an internal surface of a wall of the wellbore to seal the tubing in the wellbore;
- monitoring the pressure of the cement slurry in the annular region using the at least one pressure sensor; and
- recovering data concerning the pressure of the cement slurry monitored by the sensor to surface, the pressure data indicating the extent to which the cement slurry has travelled along the annular region towards the surface, so that a determination can be made as to whether the cementation operation has been performed correctly.

Reference is made herein to a 'fluid', which may have a use in the wellbore sealing operation. Cement is conventionally used to seal a tubing in an open portion of a wellbore. It will be understood however that the term 'fluid' is intended, in this context, to encompass other types of fluid which might be employed or developed for such sealing purposes, and which can be supplied into the wellbore in a flowable state and then cure or set into a non-flowable state where they perform the sealing function.

It will be understood that 'cement', in the context of the present invention, is a generic term used to describe the cement-based materials used in the oil and gas exploration and production industry. Also, a cement 'slurry' is a mixture of a cement and water, which is in a sufficiently fluid state prior to setting or curing that the cement can be pumped into the annular region of the wellbore. As is well known, water in a cement slurry reacts chemically with active ingredients of the cement. In particular, tricalcium silicate found in typical cements reacts to create calcium silicate hydrate. Additives are typically used to control the setting process of the cement slurry, and to enhance the performance of the set cement.

The step of monitoring the pressure of the cement slurry may comprise monitoring the hydrostatic pressure of the slurry. The pressure may be monitored following completion of the supply of the cement slurry from the wellbore-lining tubing into the annular region. This pressure may be the hydrostatic pressure of the cement slurry. It will be understood that this is the pressure exerted by the slurry when at equilibrium, due to the force of gravity, without an applied external pressure (i.e. pump pressure). Monitoring the hydrostatic pressure of the annular column of cement slurry may enable confirmation to be obtained that the cement slurry has been correctly supplied into the annular region, and that it has travelled the required distance along the length of the wellbore-lining tubing. This may facilitate determination that an adequate seal exists between the tubing and the drilled rock formations.

In more detail, for a wellbore of a known depth, with a bore-lining tubing of a known length located at a known position within the wellbore, the 'height' of the annular column of cement required to seal the tubing can be calculated. It will be understood that the wellbore may be deviated, and that the 'height' of the cement column is the length of wellbore along which the cement will extend. Also, for a wellbore of a known internal diameter and tubing of a known external diameter, the volume of the annular region having that height can be calculated. From this and with knowledge of the drilled wellbore geometry, particularly the required vertical extent (or depth) of the cement, as measured at the sensor, the hydrostatic pressure which that known volume of cement slurry should exert can be calculated. There is a therefore a correlation between the vertical extent of the cement slurry and its hydrostatic pressure. Thus monitoring the hydrostatic pressure enables the vertical extent of the cement slurry, and thus the height of the slurry column, to be determined. In this way, an assessment of whether an adequate cementation operation has been performed can be obtained. If the results indicate that a column of required height has been formed, then preparation for the next phase of drilling could go ahead whilst waiting for the cement slurry to set, with associated time and thus cost savings.

According to a third aspect of the present invention, there is provided a wellbore-lining tubing comprising:

at least one pressure sensor for monitoring the pressure of a fluid in an annular region defined between an external surface of the tubing and an internal surface of a wall of a wellbore, or between an external surface of said tubing and an internal surface of another wellbore-lining tubing in which said tubing is located, the at least one pressure sensor located on or in said tubing and communicating with the annular region for monitoring the pressure;

wherein data concerning the pressure of the fluid monitored by the at least one pressure sensor can be recovered to surface, the pressure data indicating whether a wellbore sealing operation has been performed correctly.

According to a fourth aspect of the present invention, there is provided a wellbore-lining tubing comprising:

at least one pressure sensor for monitoring the pressure of a cement slurry supplied into an annular region defined between an external surface of the tubing and an internal surface of a wall of the wellbore to seal the tubing in the wellbore, the at least one pressure sensor located on or in a surface of the tubing;

wherein data concerning the pressure of the cement slurry monitored by the at least one pressure sensor can be recovered to surface, the pressure data indicating the extent to which the cement slurry has travelled along the annular region towards the surface, so that a determination can be made as to whether the cementation operation has been performed correctly.

The wellbore-lining tubing may be casing or liner. Typically, plural concentric casing strings of decreasing diameter are located in the wellbore. Each casing may carry at least one sensor. Where a liner is employed, suspended from the smallest diameter casing in the wellbore, the liner may carry at least one sensor. The annular region primarily comprises the space between the internal wall of the wellbore and the external wall of the tubing in question. However, at least part of the annular region may comprise the space between two concentric wellbore-lining tubings of different diameters.

Further features of the methods and tubing of any of the first to fourth aspects of the present invention may be derived from the following text.

The pressure of the cement slurry may also be monitored during pumping of the slurry from the wellbore-lining tubing into the annular region. A reduction in that monitored pressure might be indicative of an undesired loss of cement slurry, for example, into a rock formation.

The data may be recovered to surface by transmission of the data to surface.

The data may be transmitted acoustically, utilising an acoustic telemetry system. The telemetry system may comprise a transmitter coupled to the at least one sensor, for transmitting acoustic sound waves to surface, the sound waves representative of or carrying the pressure data. The transmitter may be a primary transmitter, and one or more repeaters may be positioned within the wellbore, optionally on or in the wellbore-lining tubing, for receiving a signal transmitted by the primary transmitter and repeating the signal, to thereby transmit the data to surface. The repeater(s) may account for attenuation of signal strength during passage along the wellbore. The acoustic signal or signals will normally be attenuated as they travel up the wellbore-lining tubing. Typically, the more contact between the tubing and the cement, the greater the attenuation of the signal(s). This attenuation of the signal(s) may facilitate determination of the quality of a cement job, and/or may be an indicator that a bond with the tubing exists. For example, if the cement does not set and is 'green', the measured pressure values will not change with time, and this can be confirmed with the acoustic attenuation of the signal(s)—which should not change (or at least would not change to the same extent as if a good bond existed). Consequently, the existence of a cement bond may be inferred from the degree of signal attenuation which occurs. The method may therefore further comprise monitoring the extent of signal attenuation.

The data may be transmitted electrically, using an electrical transmission system. The system may comprise a transmitter coupled to the at least one sensor, for transmitting electrical signals to surface, the signals representative of or carrying the pressure data. A plurality of inductively coupled connectors may be located along the wellbore, optionally along a length of the wellbore-lining tubing, for providing an electrical pathway to transmit the data to surface. Data transmission may alternatively be via a wire or cable coupled to the transmitter, which may be incorporated into the tubing.

A tool on a separate string of tubing, or on a wireline (slickline or electric line), may be run into the wellbore, and may cooperate with an interface or hub coupled to the at least one sensor, for downloading the data. The tool may be brought into contact with the interface for downloading the data. The data may be transmitted from the interface to the tool. Data transmission may be by any suitable means such as by radio frequency or inductively. The data may be stored on or in a memory in the tubing string/wireline tool, and the tool recovered to surface for data download. The data may be transmitted through the tubing string/wireline to surface. Optionally, the data may be transmitted at least partly through the wellbore-lining tubing, and at least partly through such a tubing string/wireline tool.

For example, the data may be transmitted through the wellbore-lining tubing to the interface or hub which is located at a position uphole of the sensor, and data transferred to the tubing string/wireline tool via the interface or hub. The tubing string may be a running string coupled to wellbore-lining tubing being run into the well. The string may be a liner running string coupled to a liner. The tubing string may be a drill or other tool string used to perform an operation in the wellbore.

The data may be stored electronically in a memory device coupled to the at least one sensor, the memory device subsequently recovered to surface and the data downloaded. The memory device may be provided in a housing releasably coupled to the wellbore-lining tubing. The housing may be an annular sleeve or ring mounted internally of the wellbore-lining tubing. The housing may be coupled to the tubing by releasable restraints, such as shear pins, which can be released for recovery of the housing to surface. The housing may be drillable/millable.

The data may be transmitted to surface through fluid in the wellbore-lining tubing, via fluid pressure signals. The signals may be generated using a fluid pressure pulse generating device coupled to the at least one sensor. The device may be located in the wellbore uphole of a fluid (such as cement slurry) which is supplied into the annular region, and may only be activated to generate signals following passage of the cement slurry along the tubing and into the annular region. In this way, the device can continue to send data to surface following cementing. The method may comprise locating a casing in the wellbore extending from a wellhead, and locating a smaller diameter liner within the wellbore suspended from the casing. The device may be located in or at the liner lap, that is the top of the liner where it is coupled to the casing. The device may be located in a drill, running, or workstring coupled to said tubing and which is used to deploy said tubing into the wellbore. Cement may be supplied through the workstring into said tubing (and thus the annular region) with the device deactivated, and the device activated following completion of cementing to transmit the data to surface. In the event that a pressure drop is subsequently detected at surface (which might be indicative of a leak path in the cement or past a packer), an intervention operation may be carried out, in which the workstring is redeployed into the well and the pulse generating device coupled to the at least one sensor so that further pressure data can be recovered. This may assist in determining a location of a leak.

At least one pressure sensor may be located on or in an internal surface of the tubing. The at least one sensor may be exposed to the pressure of fluid in the annular region. The at least one sensor may be positioned downhole of a float collar of the wellbore-lining tubing, which comprises a one-way valve that permits fluid to flow from the tubing into the wellbore but prevents returns. The at least one sensor may also be positioned uphole of a shoe of the wellbore-lining tubing. In this way, the at least one sensor is exposed to the pressure of fluid in the annular region. The at least one sensor may be positioned uphole of a float collar of the wellbore-lining tubing, and may communicate with the annular region through a wall of the tubing, to thereby measure pressure in the annular region. There may be a communication port in the wall of the tubing.

At least one pressure sensor may be located on or in an external surface of the tubing. Data concerning the measured pressure may be recovered to surface along the inside of the wellbore-lining tubing. The at least one sensor may communicate with a data storage device located internally of the tubing. There may be a communication port in the wall of the tubing for coupling the at least one sensor to the data storage device. The at least one sensor may be inductively coupled to a receiver located internally of said tubing, for relaying data across a wall of the tubing. The receiver may be provided in said tubing, or in a tool deployed into the wellbore on a separate tubing string or wireline. The data may be stored in a memory for recovery to surface, or transmitted to surface, as described above.

Where applicable, the cement may be monitored by placing a pressure sensor so that, in use, the column of fluid (cement slurry) acts directly on it in an axial relationship, so that the annular column of cement is substantially perpendicular to the face of the sensor. When the cement sets, it can shrink and leave channels between it and the casing and/or formation. If the pressure sensor is in the wall of the casing such that pressure/hydrostatic pressure can act on it when the cement is in a fluid state, then when the cement sets, it becomes solid and will no longer apply pressure to the sensor, as there is a column supporting it from below. This will give an indication that the cement is actually setting on surface. Furthermore, if the sensor is located in an axial location where the weight or mass of the column may act on it, then there will still be a weight or pressure on the sensor. In these situations it may be convenient to locate a sensor in a projecting member, such as a blade or projection of a centraliser, such that it faces uphole. It may not be possible to monitor the cement column in this manner in all situations—for example in deviated or horizontal wells.

A plurality of sensors may be positioned spaced apart along a length of the wellbore-lining tubing. This may facilitate recovery of data from the wellbore at a plurality of points spaced apart along a length of the wellbore.

At least one further parameter of the fluid, optionally cement slurry, may be monitored using at least one appropriate sensor. The parameter may be temperature. Monitoring the temperature of the fluid may facilitate an improvement in the accuracy of measurements taken by a pressure sensor. For example, it may be possible to correlate the temperature of a cement slurry during setting to the measured pressure data. The density of the cement slurry downhole may be monitored. This may provide an indication of the quality of the cement.

According to a fifth aspect of the present invention, there is provided a method of determining whether a wellbore cementation operation has been performed correctly, the method comprising the steps of:

locating a wellbore-lining tubing in a wellbore;

supplying a cement slurry into an annular region defined between an external surface of the tubing and an internal surface of a wall of the wellbore, to seal the tubing in the wellbore;

locating at least one marker in a stream of the cement slurry supplied into the annular region;

monitoring for the presence of the marker in the annular region utilising a sensor in the tubing; and recovering data concerning the presence of the marker monitored by the sensor to surface, the presence of the marker indicating that the cement slurry has travelled along the annular region towards the surface to at least as far as a detectable range of the sensor, so that a determination can be made as to whether the cementation operation has been performed correctly.

The invention of the fifth aspect of the invention therefore permits a determination to be made as to whether a cementation operation has been correctly performed by monitoring for the presence of a marker in the cement slurry flowing up the annular region towards the surface. The markers may be relatively small and cheap, and a large number of markers could be provided in the stream of cement slurry, to increase the likelihood of detection by the sensor.

The at least one marker may be an active marker, which may emit a signal or indication that can be detected by the sensor. The marker may emit a radio-frequency signal which can be detected by the sensor. The marker may be an active RFID marker which may constantly emit a signal. The sensor may be an RFID reader. The at least one marker may be radioactive and may emit radiation which can be detected by the sensor. The sensor may be capable of detecting radiation above an inherent level of background radiation in the region of the sensor, thereby indicating the presence of the marker.

The at least one marker may be a passive marker which does not actively emit a signal. The method may comprise interrogating the cement slurry to detect for the presence of the marker.

The at least one marker may be a selectively activatable marker. The marker may be arranged so that it only emits a signal in the presence of the sensor. The marker may be arranged to emit a signal on detecting a radio-frequency field emitted by the sensor, which signal is subsequently detected by the sensor. The marker may be a battery assisted passive (BAP) RFID marker, having an onboard battery that is activated in the presence of the sensor, which may be an RFID reader.

The method may comprise positioning a plurality of sensors in the wellbore, which may be spaced apart along a length of the wellbore-lining tubing. This may facilitate recovery of data from the wellbore at points spaced apart along a length of the wellbore. The positioning of sensors spaced apart along the length of the tubing may provide sequential indications of the presence of the markers, and thus cement, as the cement travels uphole along the annular region.

The method may comprise positioning at least one sensor adjacent an uphole end of the wellbore-lining tubing. Detection of a marker by that sensor will then indicate that the cement slurry has passed up the annular region along at least a majority of a length of the wellbore-lining tubing. The method may comprise locating a first wellbore-lining tubing of a first diameter in the wellbore and cementing the first tubing in place; and locating a second wellbore-lining tubing of a second diameter which is smaller than the first diameter in said first tubing, and cementing the second tubing in place. The second tubing may carry a sensor which is adjacent an interface between the first and second tubings. Detection of a marker by the sensor will then indicate that the cement slurry has passed up the annular region between the external surface of the second tubing and the internal wall of the wellbore to at least a level of the intersection between the first and second tubings.

The method may comprise locating a plurality of markers in the stream of the cement slurry, and may comprise adding the markers to a stream of slurry pumped into the wellbore at spaced time intervals.

The at least one sensor may be positioned according to any one or more of the techniques discussed above in relation to the first or second aspects of the invention. The data may be recovered to surface utilising any one or more of the techniques discussed above in relation to the first or second aspects of the invention.

According to a sixth aspect of the present invention, there is provided a wellbore-lining tubing assembly comprising:

a plurality of wellbore-lining tubing sections coupled together end-to-end;

a shoe located on the lowermost section of tubing;

a float collar positioned above the shoe, the float collar comprising a one-way valve which permits fluid to be supplied from the tubing into a wellbore but which prevents the return flow of fluid from the wellbore;

a shoe track comprising at least part of at least one wellbore-lining tubing section, the shoe track extending between the shoe and the float collar;

at least one sensor for monitoring the pressure of a cement slurry supplied through the float collar and the shoe track into an annular region defined between an external surface of the tubing assembly and an internal surface of a wall of the wellbore; and an interface coupled to the sensor, through which data concerning the pressure of the cement slurry monitored by the sensor can be retrieved to surface, the pressure data indicating the extent to which the cement slurry has travelled along the annular region towards the surface so that a determination can be made as to whether the cementation operation has been performed correctly;

wherein the sensor interface is positioned above the float collar, so that access to the interface can be achieved following the cementation operation.

According to a seventh aspect of the present invention, there is provided a method of determining whether a wellbore cementation operation has been performed correctly, the method comprising the steps of:

coupling a plurality of wellbore-lining tubing sections together end-to-end;

locating a shoe on the lowermost section of tubing;

positioning a float collar above the shoe, the float collar comprising a one-way valve which permits fluid to be supplied from the tubing into a wellbore but which prevents the return flow of fluid from the wellbore, the float collar being positioned so that a shoe track comprising at least part of at least one wellbore-lining tubing section extends between the shoe and the float collar;

supplying a cement slurry through the float collar and the shoe track into an annular region defined between an external surface of the tubing assembly and an internal surface of a wall of the wellbore;

monitoring the pressure of the cement slurry in the annular region using at least one pressure sensor;

coupling an interface to the at least one sensor and positioning the interface above the float collar, so that access to the sensor interface can be achieve following the cementation operation; and retrieving data concerning the pressure of the cement slurry monitored by the at least one sensor to surface via the sensor interface, the pressure data indicating the extent to which the cement slurry has travelled along the annular region towards the surface so that a determination can be made as to whether the cementation operation has been performed correctly.

The tubing and method of the sixth and seventh aspects of the invention facilitate the monitoring of the pressure of the cement slurry supplied into the annular region, and the subsequent retrieval of the data, by the provision of the interface above the float collar. Access to the interface can be achieved even following completion of the cementation operation and setting of the cement.

Further features of the tubing and method of the sixth and seventh aspects of the present invention may be derived from the following text.

The at least one sensor may be positioned downhole of the float collar, and uphole of the shoe of the wellbore-lining tubing, so that said sensor is exposed to the pressure of fluid in the annular region. The interface, which is coupled to the sensor, permits retrieval of the measured pressure data to surface.

The at least one sensor may also be positioned uphole of the float collar, and may communicate with the annular region through a wall of the tubing, to thereby measure pressure in the annular region. There may be a communication port in the wall of the tubing. The interface may be built into a housing which also comprises the sensor.

There may be a plurality of sensors and a single interface associated with each of the sensors, or a plurality of interfaces, each associated with more than one sensor.

A separate string of tubing or a tool on a wireline (slickline or electric line) may be run-into the wellbore and brought into contact with the interface, for downloading the data. The data may be stored in a memory device on or in the tubing string/wireline tool, and the string/tool recovered to surface for data download. The data may be transmitted through the tubing string/wireline to surface. Optionally, the data may be transmitted at least partly through the wellbore-lining tubing, and at least partly through the tubing string/wireline. For example, the data may be transmitted through the wellbore-lining tubing to a location uphole of the sensor, where the interface is located, and data transferred to the tubing string/wireline tool utilising the interface. The tubing string may be a tubing running string coupled to wellbore-lining tubing being run into the well. The string may be a liner running string coupled to a liner.

The at least one sensor may be positioned according to any one or more of the techniques discussed above in relation to the first or second aspects of the invention. The data may be recovered to surface utilising any one or more of the techniques discussed above in relation to the first or second aspects of the invention.

According to an eighth aspect of the present invention, there is provided a method of determining whether a wellbore sealing operation has been performed correctly, the method comprising the steps of:

locating a wellbore-lining tubing in a wellbore, the tubing having at least one sensor;

performing a wellbore sealing operation in an annular region defined between an external surface of said tubing and an internal surface of a wall of the wellbore, or between an external surface of said tubing and an internal surface of another wellbore-lining tubing in which said tubing is located, to seal the tubing in the wellbore;

monitoring at least one material property of fluid in the annular region using the at least one sensor; and recovering data concerning the at least one material property of the fluid monitored by the sensor to surface, the data indicating whether the wellbore sealing operation has been performed correctly.

According to a ninth aspect of the present invention, there is provided a method of determining whether a wellbore cementation operation has been performed correctly, the method comprising the steps of:

locating a wellbore-lining tubing in a wellbore, the tubing having at least one sensor;

supplying a cement slurry into an annular region defined between an external surface of the tubing and an internal surface of a wall of the wellbore to seal the tubing in the wellbore;

monitoring at least one material property of the cement slurry in the annular region using the at least one sensor; and recovering data concerning the at least one material property of the cement slurry monitored by the sensor to surface, the data indicating the extent to which the cement slurry has travelled along the annular region towards the surface, so that a determination can be made as to whether the cementation operation has been performed correctly.

According to a tenth aspect of the present invention, there is provided a wellbore-lining tubing comprising:

at least one sensor for monitoring at least one material property of a fluid in an annular region defined between an external surface of the tubing and an internal surface of a wall of the wellbore to seal the tubing in the wellbore, or between an external surface of said tubing and an internal surface of another wellbore-lining tubing in which said tubing is located;

wherein data concerning the at least one material property of the fluid monitored by the at least one pressure sensor can be recovered to surface, the data indicating whether a wellbore sealing operation has been performed correctly.

According to an eleventh aspect of the present invention, there is provided a wellbore-lining tubing comprising:

at least one sensor for monitoring at least one material property of a cement slurry supplied into an annular region defined between an external surface of the tubing and an internal surface of a wall of the wellbore to seal the tubing in the wellbore;

wherein data concerning the at least one material property of the cement slurry monitored by the at least one sensor can be recovered to surface, the data indicating the extent to which the cement slurry has travelled along the annular region towards the surface, so that a determination can be made as to whether the cementation operation has been performed correctly.

The methods may be methods of determining whether a wellbore sealing operation in the form of a wellbore cementation operation has been performed correctly, or methods of determining whether a wellbore sealing operation in the form of the setting of a packer in the annular region has been correctly performed, as described above. The tubings may be for such uses.

The at least one material property may be a natural or inherent property of the fluid, which may be a cement slurry, and/or of the cured or set cement. The at least one material property may be a property of a material added to the fluid (optionally cement slurry), said material added to the fluid for the purpose of being monitored by the at least one sensor. The material property or properties measured by the at least one sensor may be selected from the group comprising mechanical; electrical; magnetic; radiological; and chemical properties. Other properties may be monitored. The at least one property may be the resistivity of the fluid, optionally cement slurry/cement. The at least one property may be the density of the fluid, optionally cement slurry/cement. It may be possible to discriminate between the resistivity or density of the fluid (optionally cement) and fluid in the annular region which it has replaced. Additives, which may be chemical additives, may be added to the fluid (optionally cement slurry) to make this differentiation easier. The additives may be radioactive and may for example be a radioactive fluid. The fluid may be chosen so that it does not substantially affect resistivity readings taken during a sealing (optionally cementing) operation.

A plurality of sensors may be provided, spaced along the length of the wellbore, to provide data concerning the fluid (optionally cement) at spaced locations along the annular region. The at least one sensor may be positioned according to any one or more of the techniques discussed above in relation to the first to fourth aspects of the invention. The data may be recovered to surface utilising any one or more of the techniques discussed above in relation to the first to fourth aspects of the invention.

The invention defined by one or more of the first to eleventh aspects of the present invention may include any of the features, options or possibilities set out elsewhere in this document, particularly in one or more of the other aspects of the invention.

References are made herein variously to components which are at 'lower', 'upper', or 'lowermost' positions within a wellbore, and/or which are 'above' or 'below' other components located in the wellbore. It will be understood that many wellbores are deviated from the vertical, and that in a deviated wellbore, a component may be located in a position which is deeper in the wellbore than another component, but not vertically below that other component. Indeed, some wellbores may terminate above the lowermost point in the wellbore, for example in a U-shape, or as an extended tangent going uphill. These references should therefore be interpreted taking account of this. For example, a reference to a component being 'lowermost' in a wellbore should be interpreted to mean that the component is at a position which is deepest in the wellbore from surface relative to some other component or components.

Embodiments of the present invention will now be described, by way of example only, with reference to the accompanying drawings, in which.

Figure 9:
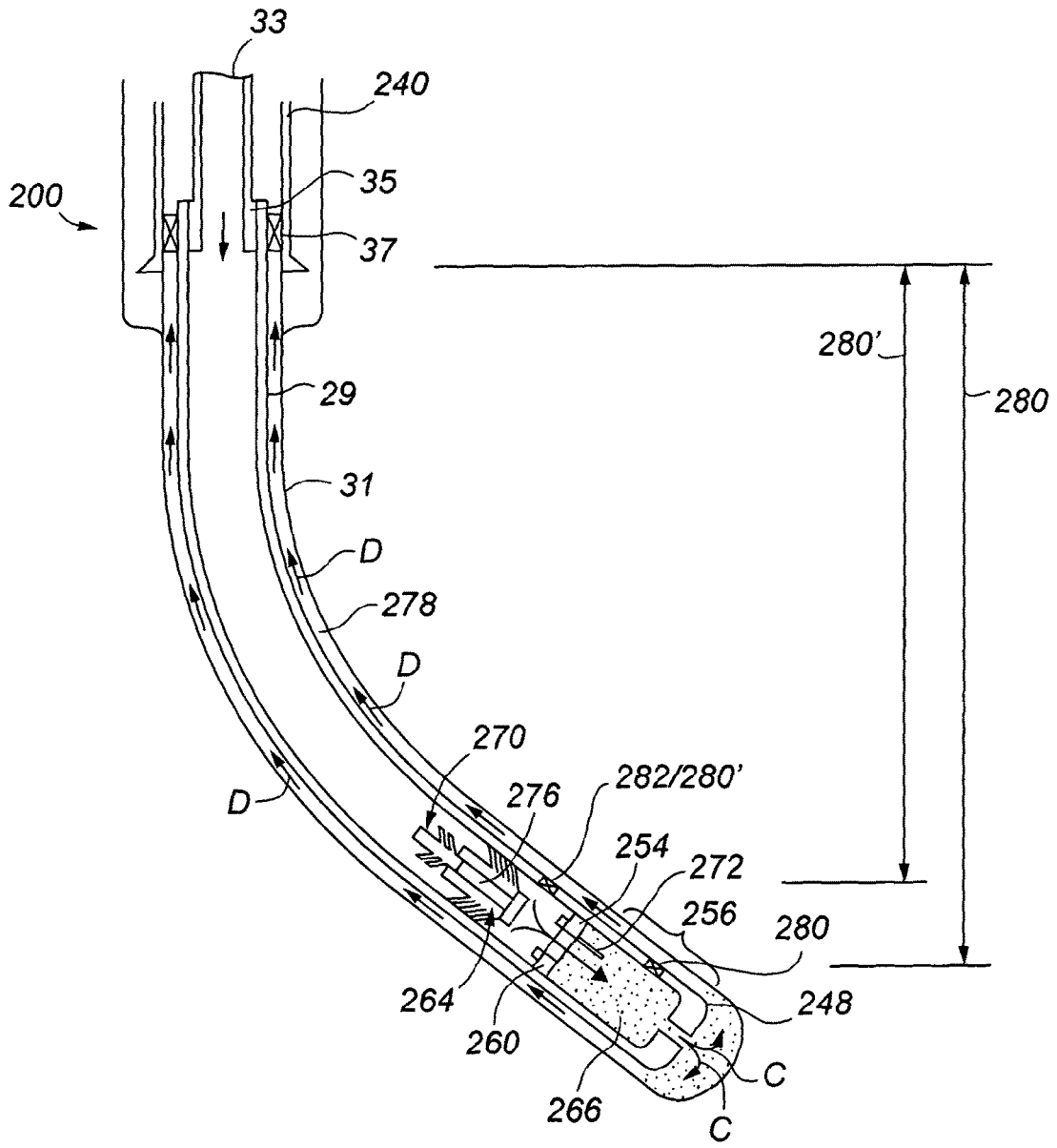
Figure 10:
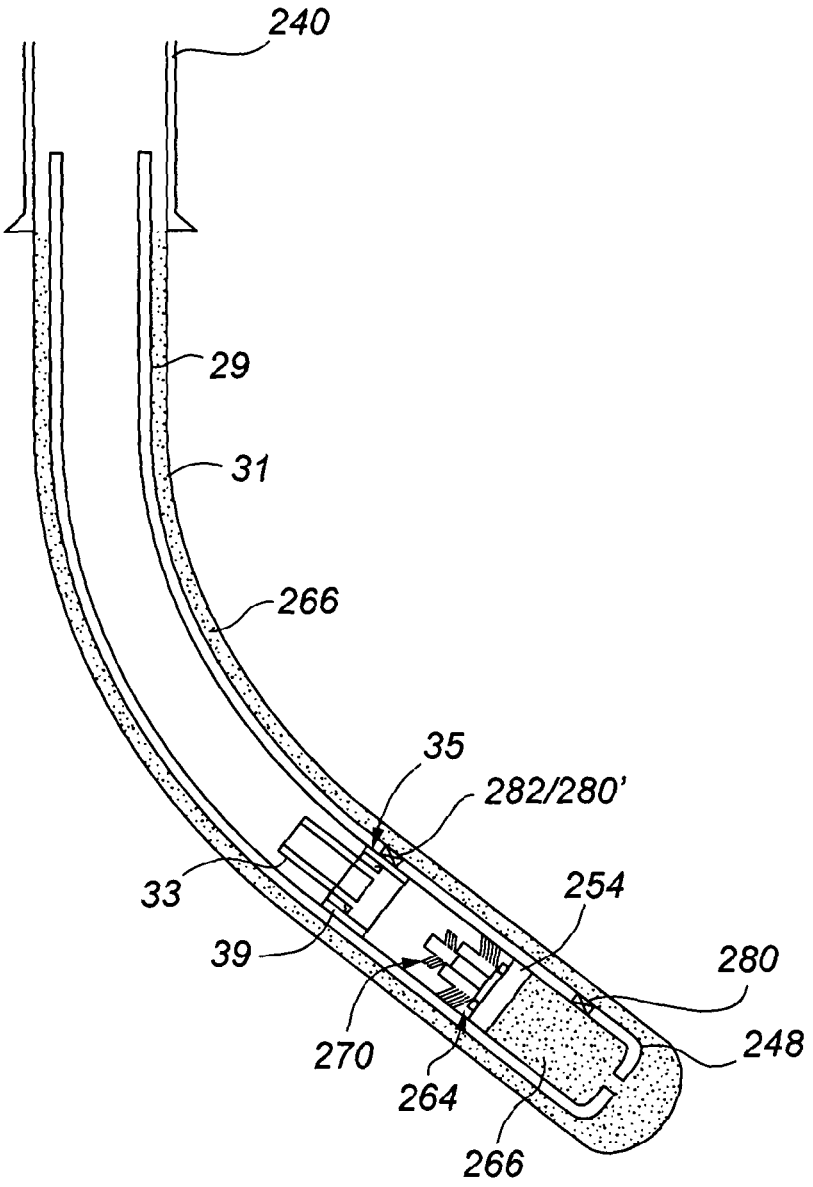
Figure 11:
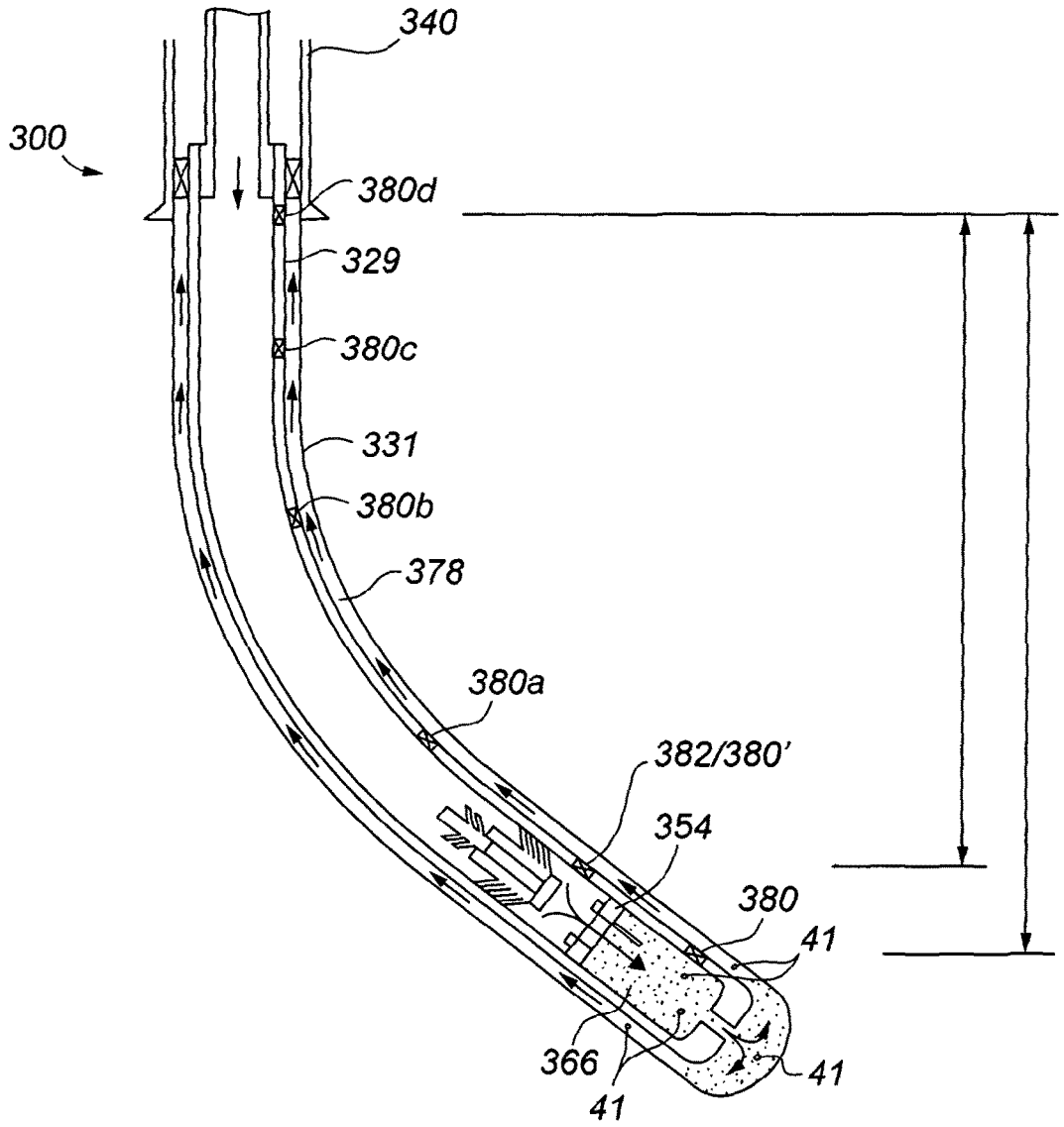
Figure 12:
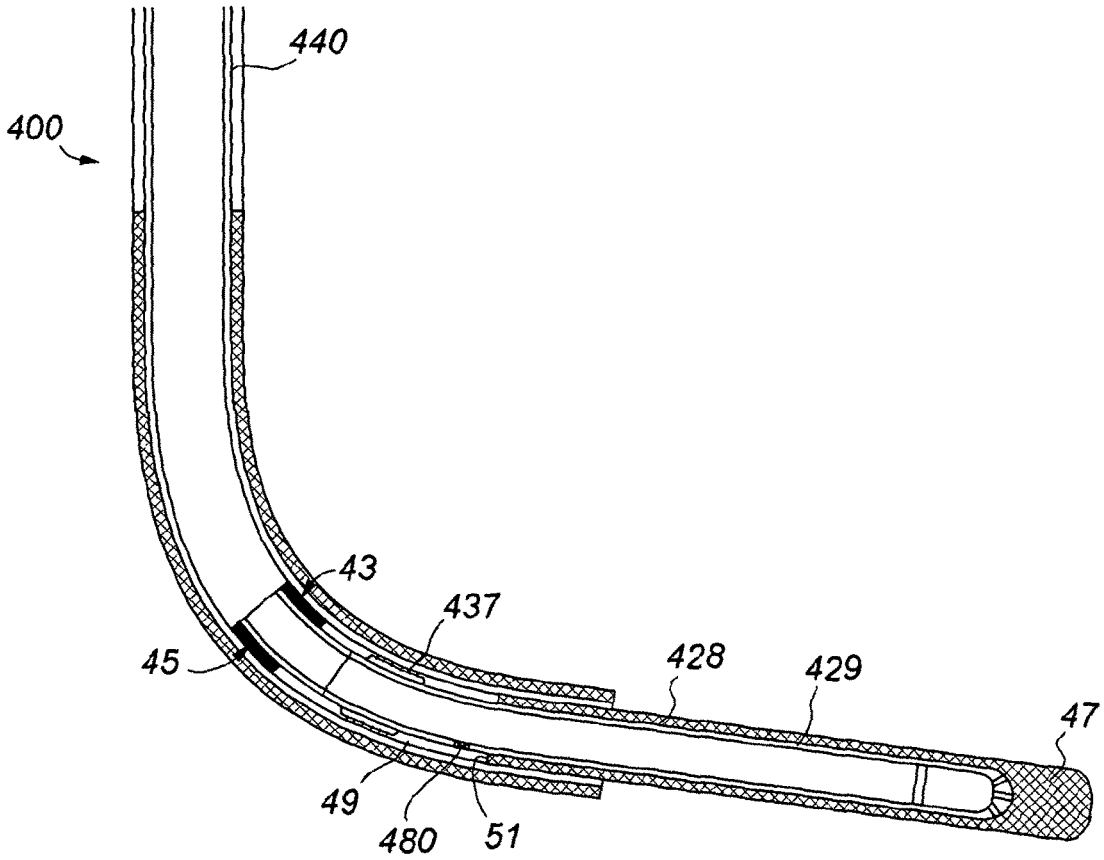

FIGS. 9 and 10 are schematic, partial longitudinal cross-sectional views of a wellbore which has been lined with wellbore-lining tubing and showing the wellbore during and following sealing by cementing the tubing in place, the Figures also illustrating steps in a method of determining whether the wellbore sealing operation has been performed correctly, and a wellbore-lining tubing, in accordance with another embodiment of the present invention;

FIG. 11 is a view similar to FIG. 9 of a wellbore which has been lined with wellbore-lining tubing and which is shown during cementation of the tubing in place, the Figure illustrating steps in a method of determining whether the wellbore cementation operation has been performed correctly, and a wellbore-lining tubing, in accordance with another embodiment of the present invention; and FIG. 12 is a schematic, partial longitudinal cross-sectional view of a wellbore which has been lined with wellbore-lining tubing, showing the wellbore following sealing with a packer and illustrating steps in a method of determining whether the sealing operation has been performed correctly, and a wellbore-lining tubing, in accordance with another embodiment of the present invention.

Figure 1:
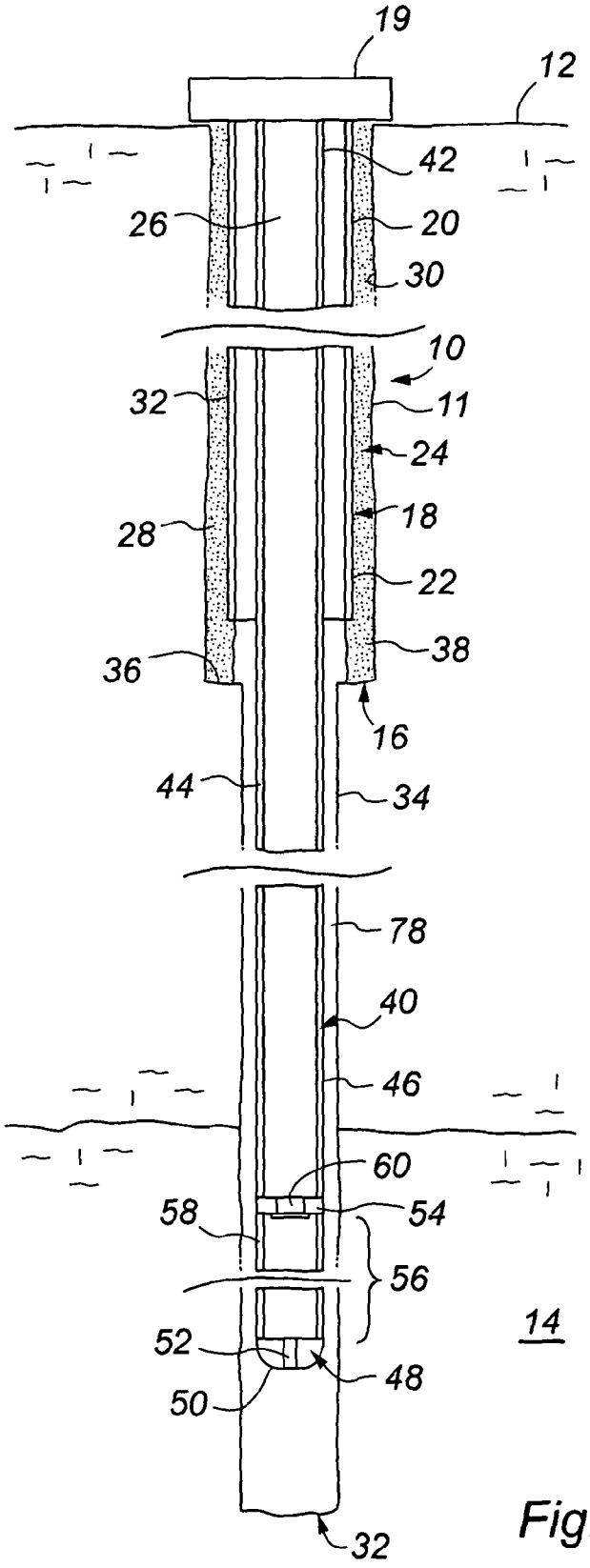
FIG. 1 is a schematic, partial longitudinal cross-sectional view of a wellbore lined with bore-lining tubing according to a known method.

Turning firstly to FIG. 1, there is shown a schematic, partial longitudinal cross-sectional view of a wellbore 10 lined with bore-lining tubing. The wellbore 10 has been drilled from the surface 12, which may be on land or a seabed, to gain access to a subterranean rock formation 14 containing hydrocarbons (oil and/or gas). The wellbore 10 has been drilled to a first depth 16 to form a first wellbore portion 11, and then lined with wellbore lining tubing in the form of a first casing 18 of a first diameter. The first casing 18 terminates at a surface wellhead 19 of a type known in the field of the invention. The first casing 18 comprises a number of casing sections coupled together end to end utilising threaded casing collars (not shown). Two casing sections 20 and 22 are shown in the drawing, but it will be understood that the first depth 16 may be many thousands of feet below the surface 12, and that a much larger number of casing sections are coupled together to form the first casing 18. Cement 24 has been supplied down a bore 26 of the casing 18 and into an annular region 28 defined between an internal surface 30 of the wellbore 10, and an external surface 32 of the casing 18. The cementing operation has been carried out to seal the casing 18 in the wellbore 10, following a conventional technique, which will be described in more detail below.

Following setting of the cement 24 and completion of any desired testing, such as a cement bond log, the wellbore 10 is extended to a second depth 32, by drilling a smaller diameter extension 34 from a foot 36 of the first wellbore portion 11, including through a cement plug 38 below the first casing 18. The extension 34 has then been lined with a second casing 40 of smaller diameter, again comprising a number of sections of casing coupled together end to end, four shown and given the reference numerals 42, 44, 46 and 58. The second casing 40 again terminates at the wellhead 19, and is shown prior to cementing in place. The cementing operation will now be described, with reference also to FIGS. 2, 3 and 4, which are views similar to FIG. 1 and illustrating various steps in the cementation operation.

To facilitate the cementing operation, the second casing 40 (and indeed the first 18 and any other casing sections located in the wellbore 10) comprises a casing shoe 48, located at a lowermost end of the casing. The shoe 48 is a short, heavy annular collar with a rounded external surface 50 that helps to prevent the casing 40 from becoming hung-up on any ledges or obstructions in the wellbore 10 during running-in. The shoe 48 has a bore 52 through which fluid can flow from the casing 40 into the wellbore 10. A float collar 54 is positioned some distance above the shoe 48, and a shoe track 56 is defined between the collar and the shoe. The shoe track typically comprises one or more casing sections coupled together and, in the drawing, comprises a single casing section 58, which has been foreshortened for illustration purposes. The float collar 54 is a short annular body having a bore 60 and a one-way valve 62 which closes the bore 60. The valve 62 may be any one of a number of types known in the field of the invention, but in the drawing is a flapper type valve which is biased to a closed position, as shown in the Figure. The flapper valve 62 permits the flow of fluid from the casing 40 into the shoe track 56 and thence into the wellbore 10, but prevents return fluid flow.

Figure 2:
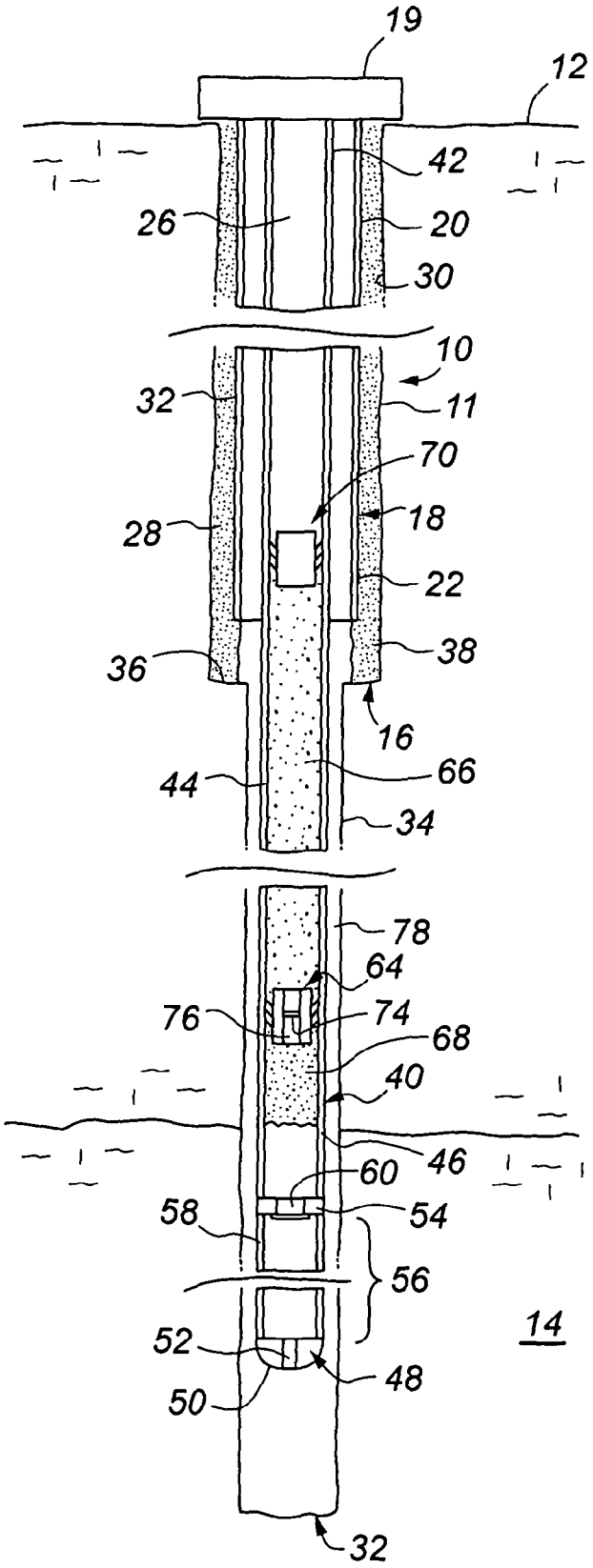
FIGS. 2, 3 and 4 are views similar to FIG. 1, illustrating various steps in an operation to seal the wellbore shown in FIG. 1, by cementing the bore-lining tubing in the wellbore.
Figure 3:
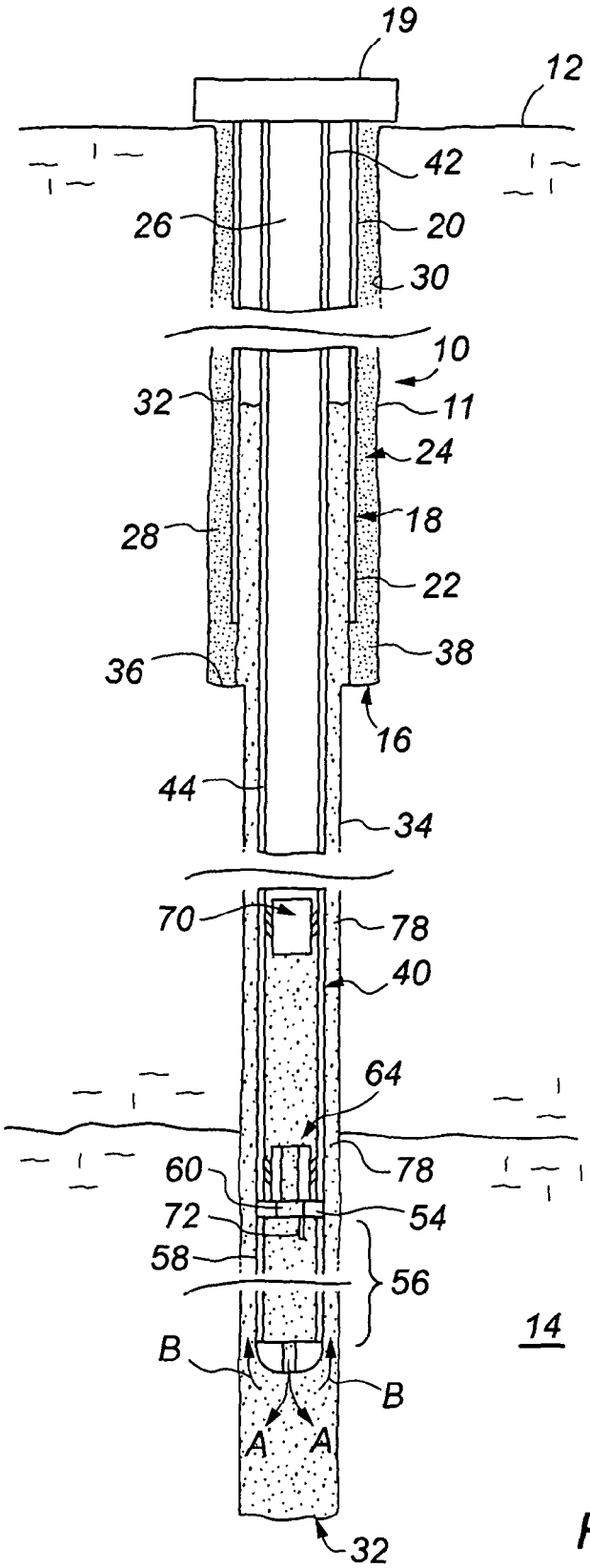

When it is desired to cement the casing 40 in place, a first or lower wiper 64 is inserted into the casing 40 at surface. A volume of cement slurry 66 is then charged into the casing 40 above the lower wiper 64. The volume of cement 66 charged into the casing 40 is calculated according to the geometry of the wellbore 10, and the casings 18 and 40, as described in detail in the introduction. An optional 'pill' 68 of a viscous fluid, such as a special treatment gel, may be pumped into the casing 40 ahead of the lower wiper 64. The gel in the pill 68 will be advanced ahead of the cement and carries out a cleaning function. A similar such pill of fluid (not shown) may be charged into the casing 40 above the cement. The lower wiper 64 provides a physical barrier between the cement 66 and fluid in the casing 40, which may comprise a mixture of wellbore fluids, drilling fluid residue, brine, chemical treatment fluids and/or the optional gel. An upper wiper 70 is positioned above the cement 66, and provides a barrier between the cement and fluid which is utilised to pump the cement and wipers 64, 70 down the casing 40. This is achieved by supplying pressurised fluid, typically water, into the casing 40 behind the upper wiper 70 utilising suitable rig pumps. The pressure of the water is sufficient to overcome the wellbore pressure at depth and forces the cement 66, trapped between the wipers 64 and 70, down the casing 40, as shown in FIG. 2.

When the lower wiper 64 has travelled sufficiently far down the casing 40, it comes into contact with and latches into the float collar 54, forcing a flapper element 72 of the valve 62 open. The pump pressure is then raised to rupture a 'burst disc' 74 or similar (FIG. 2) in the lower wiper 64, which previously blocked a bore 76 in the wiper. The cement 66 then flows, under the applied pump pressure, through the lower wiper 64 and float collar 54 into the shoe track 56, and from there through the bore 52 of the shoe 50 and into the wellbore extension 34, as indicated by the arrows A in FIG. 3. The cement 66 then flows up an annular region 78 defined between the casing 40 and a wall of the wellbore extension 34, as indicated by the arrows B. The cement flows on up the wellbore 10 towards the wellhead 19, thereby sealing the casing 40 in the wellbore.

Figure 4:
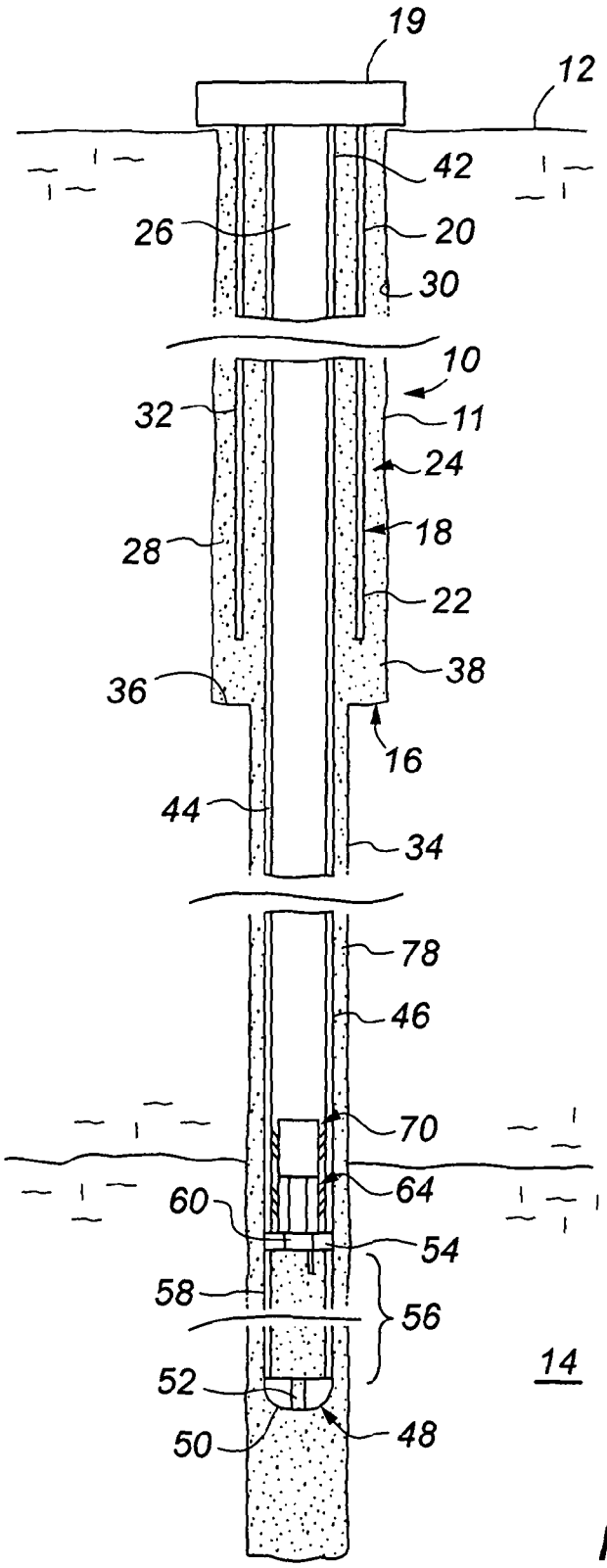

When all of the cement 66 has been forced through the float collar 54, the upper wiper 70 lands on and latches to the lower wiper 64, as shown in FIG. 4. The upper wiper 70 closes the bore 76 of the lower wiper 64 so that the latched wipers together act as a plug, which prevents return flow and U-tubing of the cement slurry 66. When it is desired to open the wellbore 10 to recover well fluids from the formation 14, the wipers 64 and 70, float collar 54 and casing shoe 48 can be drilled out. The casing 40, cement 66 and rock formation 14 is then perforated using a perforating tool (not shown), which opens fluid communication between the rock formation 14 and the interior of the casing 40. The well can then be completed by installation of production tubing (not shown), for recovery of the well fluids to surface. More typically however, the wellbore 10 will be extended to a further depth, and a further casing (not shown), of a smaller diameter than the second casing 40, will be located in the extended wellbore portion and cemented in place. The wellbore 10 may be further extended, with additional casings installed if required, until the wellbore reaches a desired depth, adjacent a formation containing hydrocarbon deposits. Although not shown in the drawings, each casing/liner installed in the wellbore will include a similar such arrangement of float collar, shoe track and shoe, which are drilled or milled out on extension of the wellbore. Thus the upper casing 18 will include a shoe which has been milled out during formation of the extended wellbore portion 34.

Figure 5:
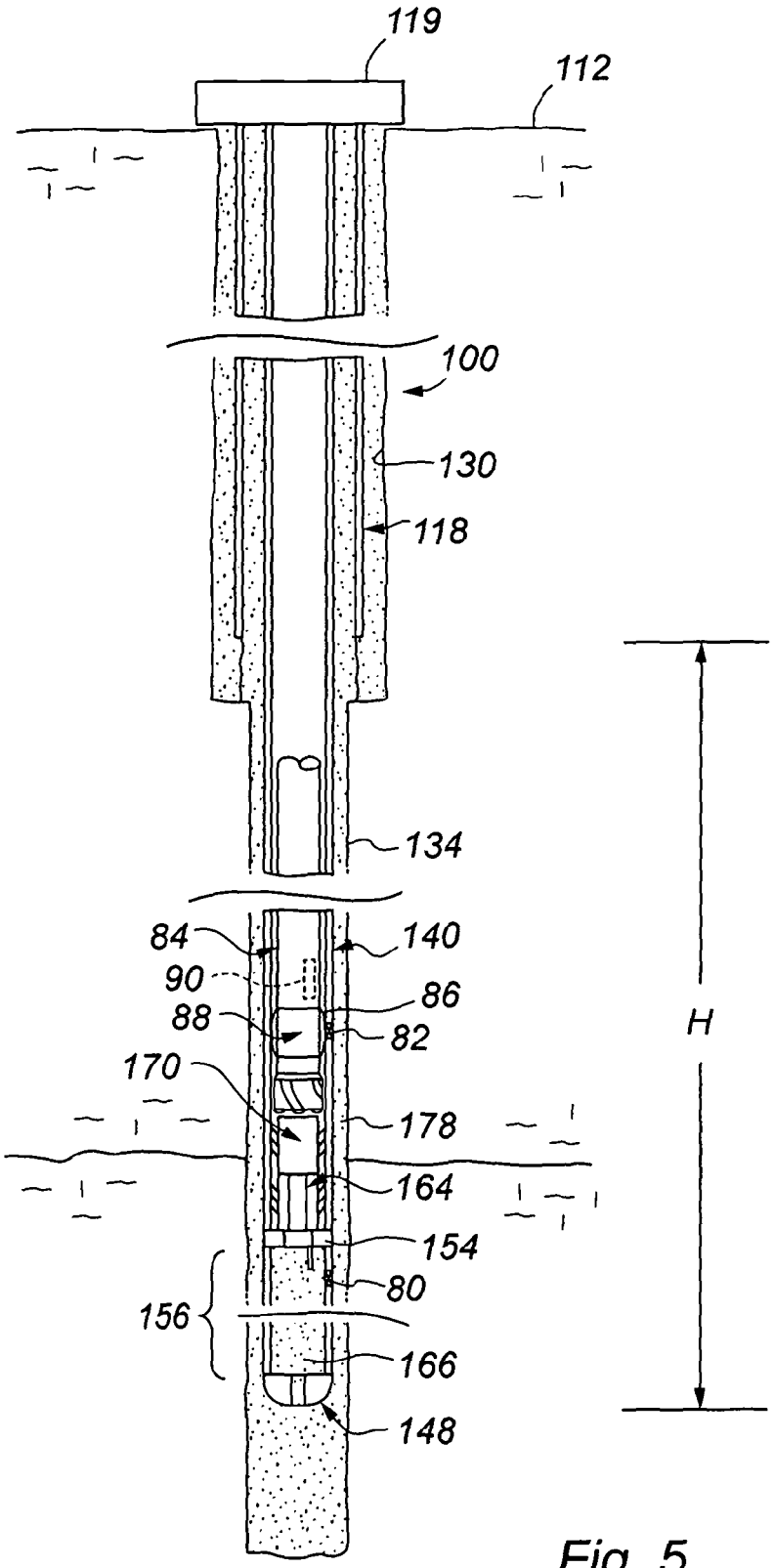
FIG. 5 is a view similar to FIG. 4 of a wellbore which has been lined with wellbore-lining tubing that has been sealed by cementing the tubing in place, the Figure illustrating steps in a method of determining whether the wellbore sealing operation has been performed correctly, and a wellbore-lining tubing, in accordance with an embodiment of the present invention.

Turning now to FIG. 5, there is shown a view similar to FIG. 1 of a wellbore 100 which has been lined with wellbore-lining tubing that has been sealed by cementing the tubing in place according to the prior technique described above. The Figure illustrates steps in a method of determining whether the wellbore sealing operation (the cementation operation) has been performed correctly, and a wellbore-lining tubing, in accordance with an embodiment of the present invention. In the Figure, wellbore-lining tubing in the form of a first casing 118 and a second casing 140 of smaller diameter are shown located in the wellbore 100. Like components of the wellbore 100 with the wellbore 10, and of the casings 118 and 140 with the casings 18 and 40 shown in FIGS. 1 to 4 share the same reference numerals, incremented by 100.

The wellbore 100 is shown immediately following completion of cementation of the casing 140 in an extension 134 of the wellbore, the casing 140 being a second casing which extends up through the larger diameter first casing 118 to a wellhead 119. The second casing 140 includes at least one pressure sensor and, in the illustrated embodiment, includes a single pressure sensor 80 which is positioned below a float collar 154. Cement slurry 166 is shown following supply into the annular region 178 defined between an external surface of the casing 140 and an internal surface 130 of a wall of the wellbore 100, to seal the tubing in the wellbore. The method involves monitoring the pressure of the cement slurry 166 in the annular region 178 using the pressure sensor 80, and recovering data concerning the pressure of the cement slurry monitored by the sensor to surface. The sensor 80 can be located on or in an internal or external surface of the casing 140. If located internally then communication with the annular region may be via a communication port (not shown). If externally located then the sensor may communicate inductively or otherwise with a receiver (not shown) internally of the casing 140, either built into the casing or in a separate tool or the like deployed into the casing. Positioning of the sensor 80 below the float collar 154 in the casing track 156 is such that the sensor is exposed to the pressure of the cement slurry 166 in the annular region 178. The pressure data retrieved from the sensor 80 indicates the extent to which the cement slurry 166 has travelled along the annular region 178 towards the surface, so that a determination can be made as to whether the cementation operation has been performed correctly.

Specifically, the wellbore 100 is of a known depth, and the casing 140 is of a known length and located at a known position within the wellbore. The 'height' H (FIG. 5) of the annular column of cement 166 required to seal the casing 140 can therefore be calculated. From this and, with knowledge of the drilled wellbore geometry, particularly the required vertical extent (or depth) of the cement column, the hydrostatic pressure which that known volume of cement slurry 166 should exert, as measured at the sensor 80, can be calculated. There is a correlation between the vertical extent of the cement slurry 166 and its hydrostatic pressure. Thus monitoring the hydrostatic pressure, utilising the sensor 80, enables the vertical extent of the cement slurry 166, and thus the height of the slurry column, to be determined.

In this way, an assessment of whether an adequate cementation operation has been performed can be obtained. A hydrostatic pressure below that which is expected for correct cementation of the annular region 178 is indicative of the height of the cement slurry column is lower than expected. Such may occur in the event of an unexpected loss of cement into the surrounding rock formations. The result of this is that the casing 140 would not be cemented along its entire length, particularly along the portion which is in the open hole, that is the unlined extension 134. In that event, a remedial cementation procedure would be carried out. This would require a cement bond log to be carried out utilising an appropriate logging tool (not shown) run into the well on wireline, to first identify the portion of the casing 140 which has not been correctly cemented. The remedial cementation would then be carried out by perforating the casing 140 in the un-cemented region and squeezing cement through the casing into the annular region 178. If however the results indicate that a column of required height has been formed—in that the hydrostatic pressure measured by the sensor 80 is at or within appropriate tolerance levels of the expected level—then preparation for the next phase of drilling/completion of the wellbore 100 could go ahead, whilst waiting for the cement slurry to set. This provides associated time and cost savings. If desired, the pressure of the cement slurry 166 may also be monitored by the sensor 80 during pumping of the slurry from the casing 140 into the annular region 178. A reduction in that monitored pressure might be indicative of an undesired loss of cement slurry 166 occurring.

The data can be recovered to surface according to one of a number of different techniques. FIG. 5 illustrates a first technique for retrieving the pressure data. In this embodiment, the casing 140 includes a sensor interface or hub 82 which is positioned above the float collar 154. The interface or hub 82 is connected to the sensor 80, such as through an electrical connection cable or wire, which may be built in to the casing. The sensor 80 and/or interface 82 include a memory for storing pressure data measurements taken by the sensor 80 during the cementation operation. A separate string of tubing, in this case a drill string 84, is run into the wellbore 100, and brought into contact with the interface 82. Contact is achieved by means of a bow spring 86 of a bow spring centraliser 88 on the drill string 84, but other suitable contact elements may be employed. This provides an electrical connection with the interface 82, so that the stored data can be downloaded into a memory device provided in the drill string 84, which is indicated in broken outline and given the reference numeral 90. However, the data may be transferred via a non-contact means, such as an inductive coupling, or some other means such as radio frequency transmission.

The drill string 84 is utilised to drill out wipers 170 and 164, a float collar 154 and a casing shoe 148, and to extend the wellbore 100. The data stored in the memory 90 is retrieved to surface through the drill string 84 and analysed to determine whether the casing 140 has been adequately cemented. The shoe track 156 etc. is then drilled or milled out and the wellbore 100 extended as required. Alternatively, the data stored in the memory 90 may be inspected on surface on retrieval of the drill string 84. It will be understood that many different types of tubing string, other than a drill string, may be utilised for retrieving the data.

Figure 6:
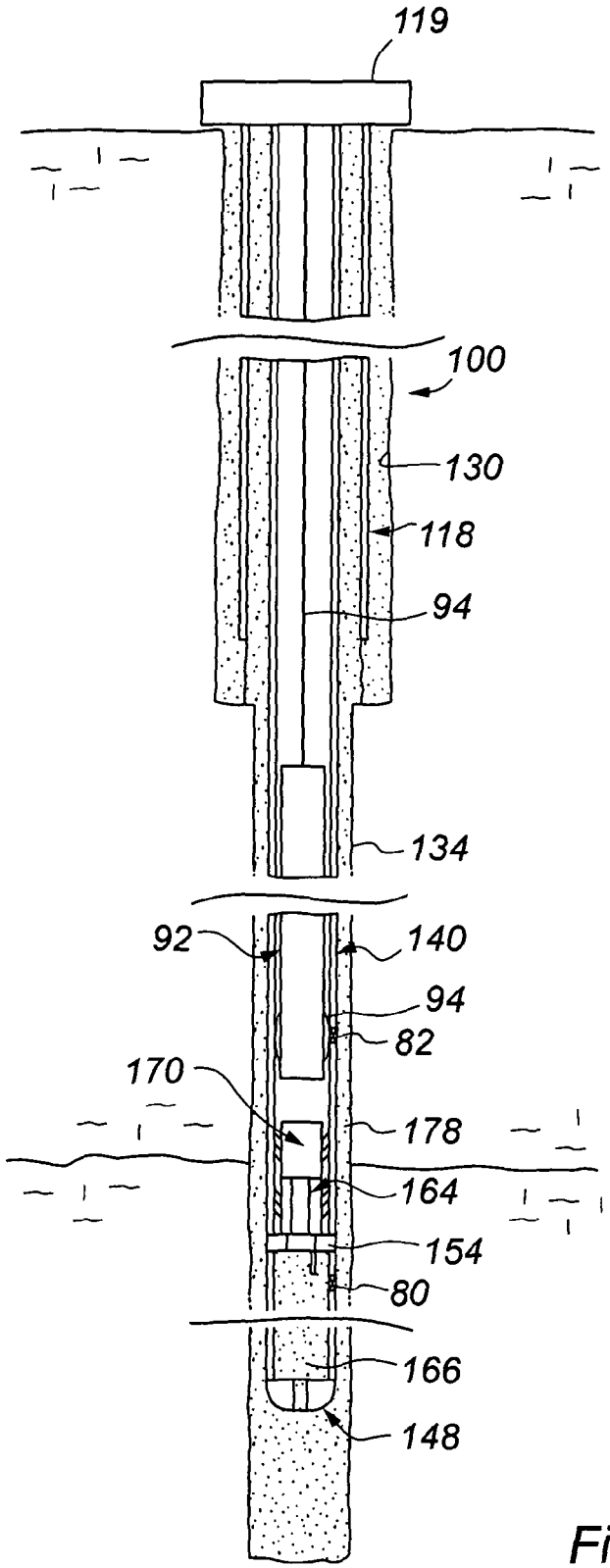
FIG. 6 is a view similar to FIG. 4 of a wellbore which has been lined with wellbore-lining tubing that has been sealed by cementing the tubing in place, the Figure illustrating steps in a method of determining whether the wellbore sealing operation has been performed correctly, and a wellbore-lining tubing, in accordance with another embodiment of the present invention.

FIG. 6 illustrates an alternative embodiment in which the data stored in the memory device in the interface 82 is retrieved to surface via a tool 92 which has been run into the wellbore 100 on a wireline, in this case, an electric line 94. The electric line 94 provides power for operation of the tool 92, which includes a memory (not shown) for storing data downloaded through the sensor interface 82. Contact with the sensor may be achieved in a number of ways, but in the illustrated embodiment, it is achieved by means of a wheel or roller which also serves for centralising the tool 92 within the casing 140. The downloaded data is then transmitted to surface through the electric line 94. In a variation, the wireline may be a slickline 94, and the data stored in memory of the tool 92 downloaded following retrieval of the tool to surface.

In a further embodiment, the data may be transmitted to surface via a wire or cable (not shown) coupled to the sensor 80, and which may be incorporated into the casing 140. The data is thus transmitted through the casing 140 to surface. Optionally, the data may be transmitted partly through the casing 140, for example to an interface or hub such as the interface 82, but located further uphole. The data may then be retrieved using a tubing string or wireline tool, as described above.

Figure 7:
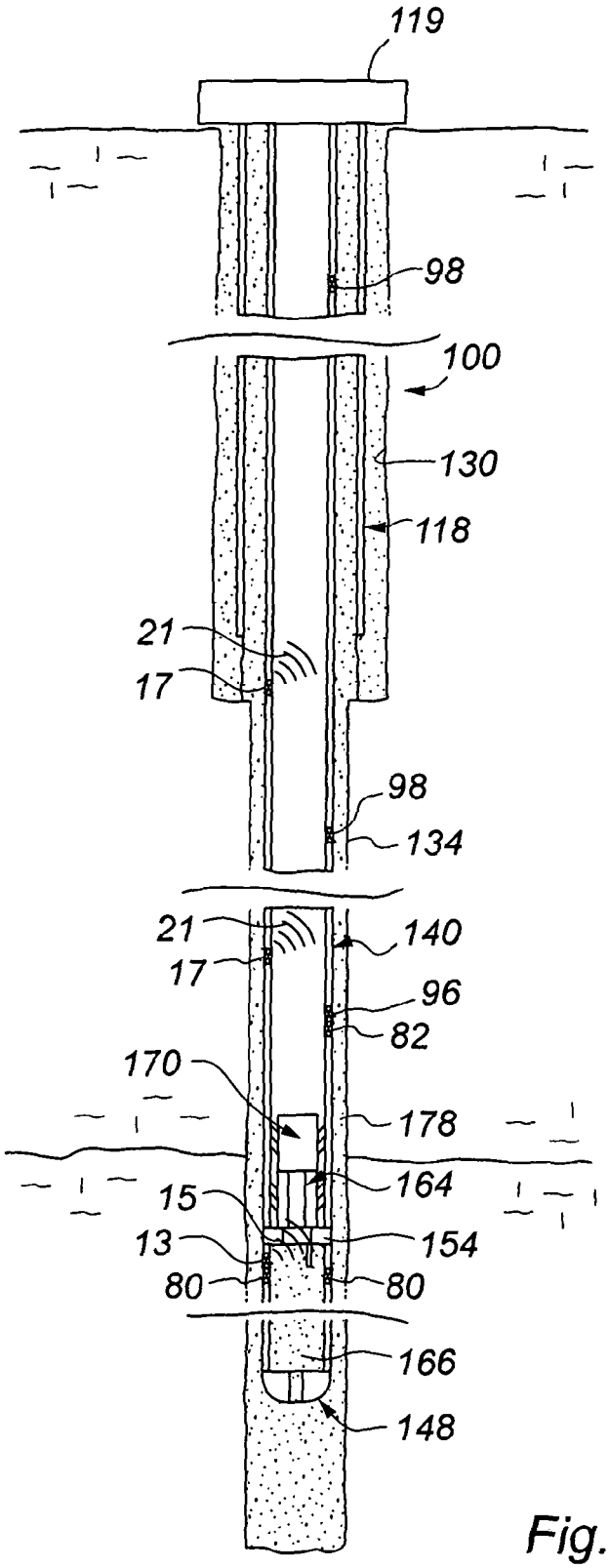
FIG. 7 is a view similar to FIG. 4 of a wellbore which has been lined with wellbore-lining tubing that has been sealed by cementing the tubing in place, the Figure illustrating steps in a method of determining whether the wellbore sealing operation has been performed correctly, and a wellbore-lining tubing, in accordance with another embodiment of the present invention.

In another embodiment, shown in the right half of FIG. 7, the interface 82 comprises a transmitter 96, for transmitting electrical signals to surface representative of or carrying the pressure data. It will be understood that the sensor 80 may alternatively comprise the transmitter 96. A plurality of inductively coupled connectors 98 are located along the length of the casing 140, for providing an electrical pathway to transmit the data to surface.

In a variation on the embodiment shown in FIG. 7, the data may be transmitted acoustically, utilising an acoustic telemetry system. The telemetry system may comprise a transmitter 13 which is coupled or built in to the sensor 80, and which is shown in the left side of FIG. 7. The transmitter 13 is arranged to transmit acoustic sound waves 15 to surface, the sound waves representative of or carrying the pressure data. Repeaters, two shown and given the reference numeral 17, may be positioned along the casing 14, for receiving the signals transmitted by the primary transmitter 13 and repeating the signals, as shown at 21, to thereby transmit the data to surface. The repeaters may account for attenuation of signal strength during passage along the wellbore 100.

Where acoustic signalling is utilised, the acoustic signals will be attenuated as they travel up the casing 140. Typically, the more contact between the tubing 140 and the cement 166, the greater the attenuation of the signal. This attenuation of the signals may facilitate determination of the quality of the cement job, and/or may be an indicator that a bond with the tubing exists. For example, if the cement does not set and is 'green', the measured pressure values will not change with time, and this can be confirmed with the acoustic attenuation of the signal(s)—which should not change (or at least would not change to the same extent as if a good bond existed). Consequently, the existence of a cement bond may be inferred from the degree of signal attenuation which occurs and the extent of signal attenuation may be monitored.

Figure 8:
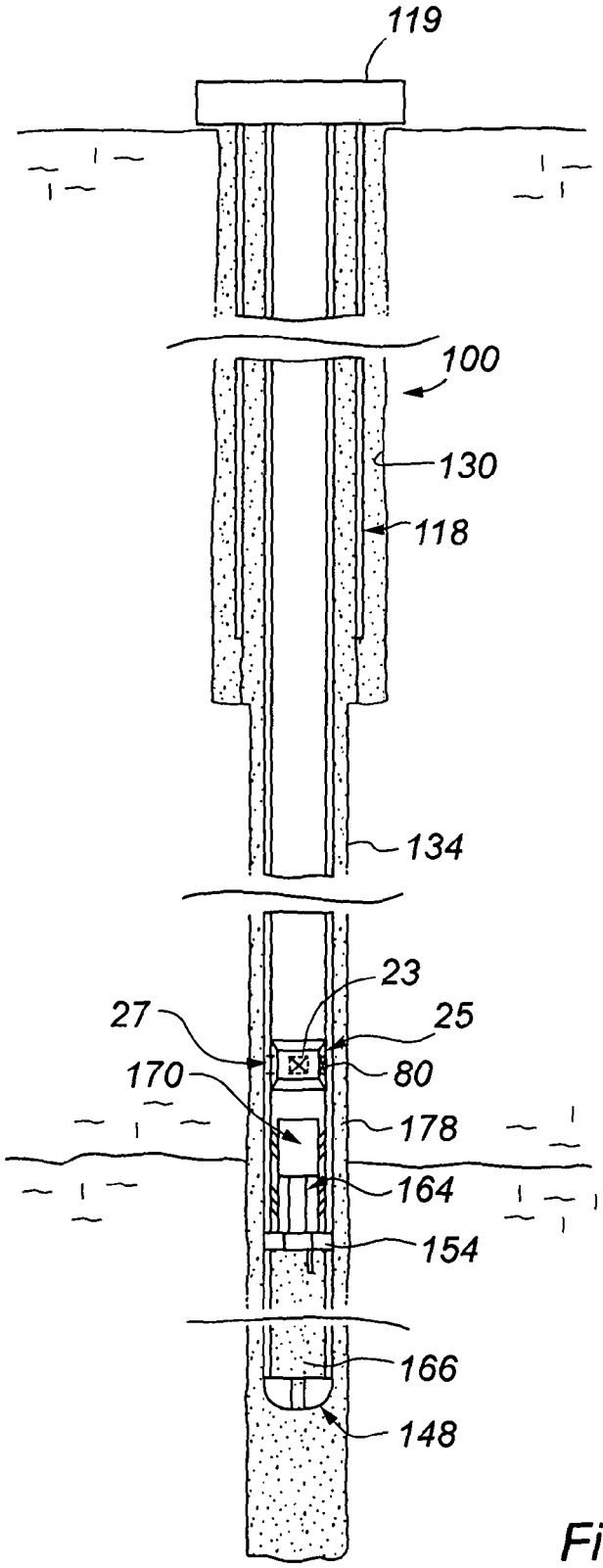
FIG. 8 is a view similar to FIG. 4 of a wellbore which has been lined with wellbore-lining tubing that has been sealed by cementing the tubing in place, the Figure illustrating steps in a method of determining whether the wellbore sealing operation has been performed correctly, and a wellbore-lining tubing, in accordance with another embodiment of the present invention.

In another embodiment, shown in FIG. 8, the sensor 80 is located above the float collar 154, and exposed to annulus pressure by means of a communication port (not shown) in the casing 140. Pressure data is stored electronically in a memory device 23 coupled to the sensor 80, the memory device subsequently recovered to surface and the data downloaded. The memory device 23 is provided in a housing in the form of an annular sleeve or ring 25, which is releasably coupled to the casing 140. The sleeve 25 is mounted internally and coupled to the tubing by releasable restraints, such as shear pins 27, which can be released for recovery of the sleeve to surface. The sleeve 25 may additionally or alternatively be drillable/millable.

In another embodiment (not shown), the data may be transmitted to surface through fluid in the casing 140, via fluid pressure pulse signals. The signals may be generated using a fluid pressure pulse generating device (not shown), coupled to the at least one sensor. A suitable device is disclosed in International Patent Publication No. WO-2011/004180 to one of the current applicants, and can be incorporated into the wall of the casing 140. The device may be located in the wellbore uphole of the cement slurry 166 which is supplied into the annular region 178, and may only be activated to generate signals following passage of the cement slurry along the tubing and into the annular region. In this way, the device can continue to send data to surface following cementation.

In the above described embodiments of the invention, the pressure sensor 80 is located on or in an internal surface of the casing 140, and exposed to the pressure of fluid in the annular region. In other embodiments, at least one pressure sensor (not shown) may be located on or in an external surface of the casing 140. Data concerning the measured pressure may then be recovered to surface along the inside of the casing, according to one of the techniques described above. This may require a communication path between the exterior and the interior of the casing 140. A plurality of sensors may be positioned in the casing 140, spaced apart along a length of the casing. This may facilitate recovery of data from the wellbore at a plurality of points spaced apart along a length of the wellbore.

Whilst the methods of the present invention have been described in relation to the second casing 140 installed in the wellbore 100, it will be understood that the methods will typically be employed to determine whether cementation of all of the wellbore lining-tubing located in the wellbore has been performed correctly (and thus including the casing 118). This will achieved following the teachings discussed above in relation to the casing 140.

Turning now to FIGS. 9 and 10, there are shown schematic, partial longitudinal cross-sectional views of a wellbore 200 lined with wellbore-lining tubing in accordance with another embodiment of the present invention. The wellbore lining tubing typically comprises a first casing (not shown), such as the casing 18 shown in FIG. 1; a second smaller diameter casing 240 similar to the casing 40 of FIG. 1; and a further wellbore-lining tubing in the form of a liner 29. Like components of the wellbore 200 with the wellbore 10 of FIGS. 1 to 4, and the wellbore 100 of FIGS. 5 to 8, share the same reference numerals incremented by 200 and 100, respectively.

The wellbore 200 is a deviated wellbore, including a portion 31 which deviates from the vertical. The liner 29 has been run-in to the wellbore 200 and located in the deviated portion 31 using a drill, running or work-string 33 which extends to surface, and which is coupled to the liner through a liner hanger running tool 35. The running tool 35 is used to activate a liner hanger 37 to suspend the liner 29 from the casing 240.

The wellbore 200 is shown in FIG. 9 immediately prior to completion of a sealing operation, in which cement slurry 266 is pumped out of the liner 29 into the deviated portion 31 of the wellbore and along an annular region 278, as indicated by the arrows C and D respectively. The cementation operation is similar to that described above in relation to FIGS. 1 to 4. However, in this instance, use of the liner 29 requires a variation to the operation, as will now be described.

The liner hanger running tool 35 carries a ported wiper 264, located in the liner 29 immediately below the running tool, and which is initially secured to the running tool by means of shear pins or the like (not shown). Following positioning of the liner 29 within the deviated portion 31, cement is charged into the drill string 33, located between the lower wiper 264 and a smaller diameter upper dart 270, which is positioned within the drill string itself. The wiper 264 includes a burst disc (not shown), which initially prevents passage of the cement through a bore 276 of the wiper. Pump pressure is increased to rupture the burst disc, whereupon the cement slurry 266 starts to flow through the wiper bore 276 and into the liner 29. From there, the cement slurry 266 flows on through a float collar 254, liner shoe track 256 and shoe 248 into the deviated portion 31 of the wellbore.

This continues until the dart 270 lands on the wiper 264, which is still coupled to the running tool 35, thereby forming a plug which prevents the flow of further fluid through the wiper bore 276. The pump pressure is then increased to shear the pins holding the wiper 264 to the running tool 35, whereupon the plug formed by the dart 270 and the wiper 264 passes down the liner 29, as shown in FIG. 9, urging the cement slurry 266 remaining in the liner 29 into the shoe track 256, and out into the wellbore 200. The wiper 264 then lands on and latches to the float collar 254, as shown in FIG. 10, and the plug formed by the dart 270/wiper 264 blocks the float collar bore 260. This prevents return flow of cement slurry 266 from the wellbore 200 into the casing 29.

The casing 29 includes a sensor 280 located in the shoe track 256, and an interface or hub 282 coupled to the sensor and positioned above the float collar 254, in a similar fashion to the casing 140 shown in FIG. 5. However, the sensor 280 may equally be positioned above the float collar 254, say in the region of the interface 282 shown in FIG. 9, following the principles discussed above, particularly in relation to FIG. 8. This alternative positioning of the sensor is indicated by the reference numeral 280' in FIGS. 9 and 10. The sensor 280' is coupled to or incorporates the interface 282.

In the illustrated embodiment, data stored by a memory device in the interface 282 is retrieved to surface utilising the liner hanger running tool 35 and drill string 33, according to the principles discussed above in relation to FIGS. 5 and 6. In this instance, contact with the interface 282 is achieved through a coupling ring 39 on the running tool 35. The drill string 33 can then be retrieved to surface. In a variation on this method, the drill string may be retrieved to surface following completion of the cementing operation, and a further tubing string run-in to the wellbore 200 to retrieve the pressure data taken by the sensor 280. This further tubing string may have a primary function of performing some other desired downhole procedure.

It will be understood that pressure data storage and transmission may alternatively be accomplished according to one or more of the techniques described above in relation to FIGS. 5 to 8. Where data is recovered using a fluid pressure pulse generating device, the device may be located in the workstring 33 coupled to the liner 29, used to deploy the liner into the wellbore 200. Cement may be supplied through the workstring 33 into the liner 29 (and thus the annular region 278) with the device deactivated, and the device activated following completion of cementing to transmit the pressure data to surface. In the event that a pressure drop is subsequently detected at surface (which might be indicative of a leak path in the cement), an intervention operation may be carried out, in which the workstring is redeployed into the well and the pulse generating device coupled to the sensor 280 so that further pressure data can be recovered. This may assist in determining a location of a leak.

Turning now to FIG. 11, there is shown a view similar to FIG. 9 of a wellbore 300 lined with wellbore-lining tubing and illustrating steps in a method of determining whether a wellbore cementation operation has been performed correctly, in accordance with another embodiment of the present invention. Like components of the wellbore 300 with the wellbore 10 of FIGS. 1 to 4, the wellbore 100 of FIGS. 5 to 8, or the wellbore 200 of FIGS. 9 and 10 share the same reference numerals incremented by 300, 200 and 100, respectively.

The wellbore 300 is shown during cementation of a liner 329 in an extension 331 of the wellbore 300, which extends from a portion of the wellbore that has been lined with a casing 340. The cementation operation is at the same stage as that shown in FIG. 9 with respect to the wellbore 200. In this embodiment of the invention, the method involves locating at least one marker 41 in a stream of cement slurry 366 supplied into an annular region 378. In the illustrated embodiment, a plurality of such markers 41 are inserted into the stream of cement slurry 366 at surface, either at timed intervals or in a volume of slurry prepared for supply downhole. Four such markers 41 are shown in the drawing, but a much larger number of markers will typically be utilized. The method involves monitoring for the presence of the markers 41 in the annular region 378, utilizing a sensor 380 in the liner 329. Data concerning the presence of the markers 41 monitored by the sensor 380 is then recovered to surface, following one or more of the techniques described above. The presence of the marker 41 indicates that the cement slurry 366 has travelled along the annular region 378 towards the surface to at least as far as to be within a detectable range of the sensor 380, so that a determination can be made as to whether the cementation operation has been performed correctly.

The sensor 380 is located below a float collar 354. As is the case for the methods and wellbore-lining tubing described above in relation to FIGS. 1 to 10, the liner 329 may include an interface or hub 382 coupled to the sensor 380, for the download of data. Alternatively, a sensor 380' may be located above the float collar 354. Typically, a plurality of sensors will be provided, spaced out along a length of the liner 329. A number of such further sensors are shown, and given the reference numerals 380*a*, 380*b* etc. It will be understood that the drawing is schematic, and that the sensors may be spaced apart, for example, many hundreds of feet. Each sensor 380, 380*a* etc. serves for detecting the presence of markers 41 within the annular region 378, so that the passage of the cement slurry 366 along the annulus can be monitored. The sensors 380, 380*a* etc. each have an effective operating range within which they can detect the presence of the markers 41, and this range will be taken into account when defining a tolerance for the cement column height determination which is made based upon the retrieved data. The sensor 380*d* is positioned adjacent an uphole end of the liner 329, at an interface or intersection between the liner and the casing 340, where it is hung from the casing. Detection of a marker 41 by the sensor 380*d* indicates that the cement slurry 366 has passed up the annular region 378 along the length of the liner 329 to the level of the intersection between the liner and the casing 340.

The markers 41 may be relatively small and cheap. In one embodiment, the markers 41 are active markers, which emit a signal or indication that can be detected by the sensor 380. The markers 41 may be active RFID markers which constantly emit a signal, and the sensor 380 an RFID reader. Alternatively, the markers 41 may be radioactive, emitting radiation which can be detected by the sensor 380. In another embodiment, the marker 41 is a passive marker which does not actively emit a signal. The markers 41 may then be passive RFID markers, and the sensor 380 may interrogate the cement slurry 366 to detect for the presence of the markers. In a further embodiment, the markers 41 are selectively activatable. The markers 41 may be arranged so that they only emit a signal in the presence of the sensor 380. For example, the markers 41 may be arranged to emit a signal on detecting a radio-frequency field emitted by the sensor 380, which signal is subsequently detected by the sensor. The markers 41 may be battery assisted passive (BAP) RFID markers, having onboard batteries that are activated in the presence of the sensor 380, which may be an RFID reader.

Turning now to FIG. 12, there is shown a schematic, partial longitudinal cross-sectional view of a wellbore 400 which has been lined with wellbore-lining tubing, showing the wellbore following sealing with a packer and illustrating steps in a method of determining whether the sealing operation has been performed correctly, and a wellbore-lining tubing, in accordance with another embodiment of the present invention.

The wellbore lining tubing typically comprises a first casing (not shown), such as the casing 18 shown in FIG. 1; a second smaller diameter casing 440 similar to the casing 40 of FIG. 1; and a further wellbore-lining tubing in the form of a liner 429. Like components of the wellbore 400 with the wellbore 10 of FIGS. 1 to 4, the wellbore 100 of FIGS. 5 to 8, the wellbore 200 of FIGS. 9 and 10, and the wellbore 300 of FIG. 11, share the same reference numerals incremented by 400, 300, 200 and 100, respectively.

The drawing shows a seal in the form of a packer 43, which is set in an annular region 428 defined between an external wall of the liner 429 and an internal wall of the casing 440. The packer 43 is located above a liner hanger 437, which is used to hang the liner 429 from the casing 440. The method involves determining whether a wellbore sealing operation in the form of the setting of the packer 43 in the annular region 428 has been correctly performed. The packer 43 is of a type known in the industry as a liner-top packer, and comprises a sealing element 45 which is urged radially outwardly into sealing abutment with the casing 440 by imparting an axial force on the packer. This is achieved employing a packer setting tool of a type known in the industry.

Cement 47 is supplied into the annular region 428 following the techniques discussed above, to perform a primary sealing of the liner 428 in the wellbore 400. The packer 43 is positioned uphole of the cement 47, and indeed of the liner hanger 437, so that a space 49 is defined between an uphole surface or end 51 of the cement and the sealing element 45 of the packer. In this embodiment, data is recovered to surface relating to the pressure of a fluid in the annular region 428 downhole of the packer sealing element 45, in the space 49. This fluid will typically be a viscous fluid, such as a special treatment gel which is pumped into the casing liner 429 ahead of a lower wiper (not shown) during the cementing operation. It will be appreciated however that the fluid in the space may be a wide range of other fluids or combinations thereof.

The method involves monitoring the pressure of the fluid in the space 49 using a pressure sensor 480 which communicates with the space. A change in the pressure of the fluid might be indicative of a leak path existing past the packer sealing element 45, and so that the packer 43 has not been correctly set. The data concerning the measured pressure is recovered to surface following the techniques discussed above. In the event of a leak path being detected, an intervention procedure can be carried out to exert a further setting force on the packer 43 to ensure activation of the sealing element 45.

It will be appreciated that the method discussed above in relation to FIG. 12 may comprise monitoring both the pressure of the cement slurry during cementation of the liner 429 using another sensor in the liner 429 (not shown), and monitoring the pressure of the fluid in said space 49 using the pressure sensor 480. This may enable data to be obtained which confirms both that the cementation operation has been performed correctly, and that the packer 43 has been properly set. Indeed, a change in the pressure of the fluid in the annular space 49 might be indicative of the cement bond being inadequate, rather than that the packer 43 has not been adequately set. This can however be determined by monitoring the pressure of the cement slurry following the techniques discussed above.

In a variation, the sealing element 45 of the packer 43 may be a swellable sealing element, which swells and radially expands into sealing abutment with the casing 440 (or a wall of the wellbore 400, where applicable) on exposure to fluid in the wellbore. Such swellable packers and known in the industry, and have sealing elements which swell on exposure to hydrocarbon-containing fluids (e.g. oil), water or other fluids.

Also, in the event that a pressure drop is subsequently detected at surface, which might be indicative of a leak path existing past the packer 43, an intervention operation of the type described above may be carried out, in which a workstring is redeployed into the well and a pulse generating device coupled to the sensor 480 so that further pressure data can be recovered.

Furthermore, it will be understood that a packer may be provided in the open hole, that is between the liner 429 and the wall of the wellbore 400 (or indeed between one of the casings described above and the wall of the respective wellbore). The principles of the disclosed method/tubing apply equally to this situation.

A number of different methods for determining whether a wellbore sealing operation (which may be a cementation operation or the setting of a packer) has been performed correctly, and a number of different types of wellbore-lining tubing, are disclosed in this document. It will be understood that the features of one or more of these methods/tubings may be provided in combination. Thus a further embodiment or embodiments of the present invention may combine the features of one or more of the embodiments above described.

Various modifications may be made to the foregoing without departing from the spirit or scope of the present invention.

For example, at least one further parameter of the cement slurry may be monitored using at least one appropriate sensor. The parameter may be temperature. Monitoring the temperature of the cement may facilitate an improvement in the accuracy of measurements taken by a pressure sensor. For example, it may be possible to correlate the temperature of the cement slurry during setting to the measured pressure data. The density of the cement slurry downhole may be monitored. This may provide an indication of the quality of the cement.

The cement may be monitored by placing a pressure sensor so that the column of fluid (cement slurry) acts directly on it in an axial relationship, so that the annular column of cement is perpendicular to the face of the sensor. When the cement sets, it can shrink and leave channels between it and the casing and/or formation. If the pressure sensor is in the wall of the casing such that pressure/hydrostatic pressure can act on it when the cement is in a fluid state, then when the cement sets, it becomes solid and will no longer apply pressure to the sensor, as there is a column supporting it from below. This will give an indication that the cement is actually setting on surface. Furthermore, if the sensor is located in an axial location where the weight or mass of the column may act on it, then there will still be a weight or pressure on the sensor. In these situations it may be convenient to locate a sensor in a projecting member, such as a blade or projection of a centraliser, such that it faces up hole. It may not be possible to monitor the cement column in this manner in all applications—for example in deviated or horizontal wells.

In a variation on the method/tubing shown in the drawings and described above, a method/tubing may be provided which employs at least one sensor for monitoring at least one material property of the cement slurry. The at least one material property may be a natural or inherent property of the cement slurry and/or of the cured or set cement. The at least one material property may be a property of a material added to the cement slurry, said material added to the cement slurry for the purpose of being monitored by the at least one sensor. The material property or properties measured by the at least one sensor may be selected from the group comprising mechanical; electrical; magnetic; radiological; and chemical properties. Other properties may be monitored. The at least one property may be the resistivity of the cement slurry/cement. The at least one property may be the density of the cement slurry/cement. It may be possible to discriminate between the resistivity or density of the cement and the fluid in the annular region which it has replaced. Additives, which may be chemical additives, may be added to the cement slurry to make this differentiation easier. The additives may be radioactive and may for example be a radioactive fluid. The fluid may be chose so that it does not substantially affect a resistivity readings taken during a cementing operation.

The invention claimed is:

1. A method comprising:

locating a first wellbore-lining tubing in a wellbore, the first wellbore-lining tubing including a tubing wall having internal and external surfaces and at least one pressure sensor positioned in the internal or external surface of the tubing wall and exposed to an annular space defined between (1) the first wellbore-lining tubing and the wellbore or (2) the first wellbore-lining tubing and a second wellbore-lining tubing disposed between the wellbore and the first wellbore-lining tubing;

performing a wellbore sealing operation that includes supplying a cement slurry into the annular space;

monitoring a pressure in the annular space with the at least one pressure sensor;

calculating a desired hydrostatic pressure of an annular column of the cement slurry within the annular space based on a desired height of the annular column; and determining whether the wellbore sealing operation has been performed correctly by comparing a measured hydrostatic pressure in the annular space with the desired hydrostatic pressure.

2. The method of claim 1 further comprising:

setting a packer in the wellbore upstream of the first wellbore-lining tubing so as to define an uphole end of the annular space, wherein determining whether the wellbore sealing operation has been performed correctly includes determining whether the packer has sealed the uphole end of the annular space.

3. The method of claim 1, wherein monitoring the pressure occurs while supplying the cement slurry into the annular space.

4. The method of claim 1, wherein monitoring the pressure comprises collecting pressure data and recovering the pressure data.

5. The method of claim 4, wherein recovering the pressure data comprises transmitting the pressure data to a surface location at the wellbore by at least one of acoustic sound waves, electrical signals, and fluid pressure signals.

6. The method of claim 4, wherein recovering the pressure data comprises:

storing the pressure data in a memory that is coupled to the at least one sensor or that is coupled to a tool positioned in the wellbore; and recovering the memory.

7. The method of claim 1, wherein the first wellbore-lining tubing comprises a shoe that comprises a float collar, the method further comprising positioning the at least one sensor downhole of the shoe.

8. The method of claim 1 further comprising:

positioning the at least one pressure sensor so that the cement slurry acts directly on the at least one pressure sensor in an axial relationship.

9. The method of claim 1, wherein the at least one sensor is positioned in the tubing wall of the first wellbore-lining tubing proximal to an uphole end of the first wellbore-lining tubing.

10. The method of claim 1 further comprising:

monitoring at least one fluid parameter in the annular space using at least one corresponding sensor, wherein the at least one fluid parameter is at least one of: temperature, density, or resistivity; and correlating the at least one fluid parameter with the pressure in the annular space.

11. The method of claim 1 further comprising:

performing a remedial cementing operation when the measured hydrostatic pressure in the annular space is different than the desired hydrostatic pressure.

12. The method of claim 1, further comprising calculating the desired height of the annular column based on a known depth of the wellbore, a known length of the first wellbore lining tubing, and a known position of the first wellbore lining tubing within the wellbore.

13. A system, comprising:

a first wellbore-lining tubing disposed within a wellbore penetrating a subterranean formation and including a tubing wall having internal and external surfaces;

an annular space defined between (1) the first wellbore-lining tubing and the wellbore or (2) the first wellbore-lining tubing and a second wellbore-lining tubing disposed between the wellbore and the first wellbore-lining tubing; and at least one pressure sensor positioned in the internal or external surface of the tubing wall and exposed to the annular space to measure a pressure in the annular space, wherein the at least one pressure sensor monitors a hydrostatic pressure of a cement slurry within the annular space, and wherein the hydrostatic pressure is compared against a desired hydrostatic pressure of an annular column of the cement slurry within the annular space to determine when the cement slurry reaches a desired height.

* * * * *